US005711217A

United States Patent [19]

Boring

[11] Patent Number: 5,711,217

[45] Date of Patent: Jan. 27, 1998

[54] VECTOR SCREEN PRINTING METHOD AND APPARATUS

[75] Inventor: David E. Boring, East Berlin, Pa.

[73] Assignee: Ser-Tek Systems, Inc., Hanover, Pa.

[21] Appl. No.: 529,755

[22] Filed: Sep. 18, 1995

[51] Int. Cl.[6] ..... B41F 17/30

[52] U.S. Cl. ..... 101/123; 101/38.1; 101/39

[58] Field of Search ..... 101/38.1, 39, 40, 101/40.1, 123, 124, 129

[56] References Cited

U.S. PATENT DOCUMENTS

| | | | |
|---|---|---|---|
| 2,635,533 | 4/1953 | Stewart | 101/40 |
| 3,024,722 | 3/1962 | Jamison, Sr. et al. | 101/40 |
| 3,247,786 | 4/1966 | Heyne et al. | 101/38.1 |
| 3,405,633 | 10/1968 | Price, Jr. et al. | 101/37 |
| 3,538,845 | 11/1970 | Peck et al. | 101/40.1 |
| 3,564,998 | 2/1971 | Johnson | 101/40 |
| 3,659,523 | 5/1972 | Olsen | 101/38.1 |
| 3,970,831 | 7/1976 | Hegyi | 318/568.1 |
| 3,979,247 | 9/1976 | Berg | 156/297 |
| 4,057,893 | 11/1977 | Smith et al. | 29/560 |
| 4,109,573 | 8/1978 | Strauch et al. | 101/38.1 |
| 4,282,806 | 8/1981 | Lala | 101/38.1 |
| 4,304,180 | 12/1981 | Lala et al. | 101/40 |
| 4,469,022 | 9/1984 | Meador | 101/38.1 |
| 4,502,380 | 3/1985 | Meador | 101/38.1 |
| 4,817,524 | 4/1989 | Riemer | 101/123 |
| 4,848,227 | 7/1989 | Campioli | 101/39 |
| 4,889,050 | 12/1989 | Meador | 101/38.1 |
| 5,050,496 | 9/1991 | Klemm | 101/123 |
| 5,158,016 | 10/1992 | Dubuit | 101/123 |
| 5,339,732 | 8/1994 | Peterlini et al. | 101/38.1 |
| 5,553,547 | 9/1996 | Miller | 101/38.1 |

FOREIGN PATENT DOCUMENTS

| | | | |
|---|---|---|---|
| 3609619 | 9/1987 | Germany | 101/38.1 |

OTHER PUBLICATIONS

ACROBOT—1000, Permanent Label Corp., Applying Technology to Creative Decoration, 1986, 2 pages.

Balsfulland, CNC–1000 Siebdruckanlage Screen–printing–machine, Machine de seriegraphie, 4 pages.

CER, Machines A Imprimer—Printing Machines—Druckmaschinen, 6 pages.

*Primary Examiner*—Stephen R. Funk

*Attorney, Agent, or Firm*—Sixbey, Friedman Leedom & Ferguson; Charles M. Leedom, Jr.; Eric J. Robinson

[57] ABSTRACT

A system and method for imprinting an object including both irregularly shaped or non-round objects and regularly shaped round and/or rectangular objects and combinations thereof in which a plurality of positioning vectors are computed to control operation of the apparatus to effect imprinting of the object. The positioning vectors are generated by an electronic control unit and are used to control the position of at least one of a print screen of the printing apparatus, a squeegee of the printing apparatus, and an object to be imprinted. Servo-motors, or other suitable mechanical actuators, are connected to the electronic control unit and position the appropriate components of the printing apparatus to effect printing of the object in response to commands received therefrom.

26 Claims, 15 Drawing Sheets

VECTOR SCREEN PRINTING METHOD AND APPARATUS

TECHNICAL FIELD OF THE INVENTION

This invention is generally related to a printing method and apparatus for quickly and easily imprinting both irregularly shaped or non-round objects, and regularly shaped round and/or rectangular objects and combinations thereof, and in particular to such a method and apparatus that employs computer controlled servo-motors to accurately control the positional relationship between an object to be imprinted and a printing screen and squeegee.

BACKGROUND OF THE INVENTION

Silk-screen printing is generally performed by forcing ink through openings in a prepared screen matrix held against an object that is to be imprinted. The screen matrix is typically prepared by coating a screen with a plastic material which fills the openings between the screen threads. The plastic material is then selectively removed, resulting in areas in the screen matrix that will allow ink to pass therethrough. The screen matrix is held against an object to be imprinted and ink is forced through the screen using a spatula type device, or "squeegee," so that the pattern of open areas will result in the creation of an image on the object to be imprinted.

When silk-screen printing is to be performed on a round object, it is generally required that the object and screen matrix move relative to one another. Normally, the round object will be mounted on a rotational support and the screen matrix (or squeegee and object) moved linearly at a speed that matches exactly the surface speed of the rotating object. The application of the squeegee at the line of contact between the screen matrix and the round object causes ink to be forced through the screen matrix. The resulting rolling relationship between the round object and the screen matrix allows an image to be transferred by the squeegee as if the object and screen were in static contact.

The above described method can be adapted for imprinting multiple round objects each having differing diameters. By appropriately adjusting the distance between the rotational support on which each round object is held and the screen matrix, and by maintaining the relationship between the surface speed of the round object and the linear speed of the screen matrix (either by varying the linear speed of the screen matrix or the rotational speed of the object to be imprinted), objects of varying diameters can be imprinted. Generally, however, this distance must be manually adjusted and therefore such adjustment is time consuming in practice.

U.S. Pat. No. 4,304,180 to Lala et at. is directed to a bottle printer that includes a fixed screen and a carriage that includes both a squeegee and a bottle support mounted thereon such that the squeegee and bottle support move together relative to the printing screen. By providing a single carriage on which both the squeegee and the bottle support are mounted for unitary movement, the speed of the squeegee automatically corresponds with the bottle rotation regardless of the bottle diameter. To imprint bottles of differing diameters in which the speed of rotation of the bottle must be controlled, however, Lala et at. requires that gear wheels of varying diameters corresponding to the different bottle diameters be utilized. Therefore, as described above, substantial physical modifications to the bottle printer of Lala et at. is required to imprint multiple round objects each having different diameters. Furthermore, the bottle printer of Lala et at. is only capable of imprinting round objects and no provision is made for imprinting of irregular, or non-round, objects.

One method of imprinting irregular or non-round objects involves the use of a complex system of mechanical linkages that act to shift the center about which the non-round object rotates to coincide with the current center of curvature of the surface to be imprinted. For many non-round objects, such as a true oval object, the radius defining the center of curvature is not a fixed value but rather continuously varies during the printing process. Such continuously varying radii, however, generally cannot be adequately approximated with mechanical linkages alone and it is necessary to further incorporate a cam mechanism.

Furthermore, a specific cam mechanism is generally required for each different object to be imprinted. Thus, the setup of the printing apparatus including installation of an appropriate cam mechanism and adjustment of the linkages must be performed for each variation in the form of the object to be printed. Because of the cost involved in the design and manufacture of the required linkages and cams, and also in the setup of the printing apparatus, it is generally desirable to limit the number of object forms. As a consequence, designers are constrained to a limited number of non-round objects.

An example of one such device is discussed in U.S. Pat. No. 4,848,227 to Campioli, which is directed to a device for silk-screening printing of cylindrical objects having elliptical cross sections wherein the device includes a toothed sector having a pitch circle diameter corresponding to a curvature of a cylindrical surface of an object to be printed. Campioli states that the device can be easily adjusted, using various diameter toothed sectors, to print objects of different curvatures. Again, however, a plurality of toothed sectors having different pitch circle diameters, each corresponding to a different curvature of a cylindrical surface of an object to be printed, must be utilized. Furthermore, if a plurality of objects each having a different form are to be printed, the toothed sector must be removed from the printing apparatus and a new, appropriately formed toothed sector installed. Therefore, substantial physical modifications of the printing apparatus are again required for imprinting objects having varying forms, thus reducing the efficiency of the printing process.

SUMMARY OF THE INVENTION

It is a primary object of the present invention to provide a printing apparatus and method for imprinting both irregularly shaped or non-round objects and regularly shaped round and/or rectangular objects and combinations thereof that overcomes the above-discussed problems.

It is a further object of the present invention to provide an improved printing apparatus and method capable of imprinting both irregularly shaped or non-round objects and regularly shaped round and/or rectangular objects and combinations thereof.

It is yet another object of the present invention to provide a printing apparatus and method for imprinting irregularly shaped or non-round objects that does not rely upon mechanical linkages or cams to effect imprinting of the objects.

It is a still further object of the present invention to provide a printing apparatus and method for quickly and easily imprinting a plurality of different irregularly shaped or non-round objects without substantial physical modification of the printing apparatus.

It is another object of the present invention to provide a printing apparatus and method capable of imprinting both irregularly shaped or non-round objects and regularly shaped round and/or rectangular objects and combinations thereof without substantial modifications to the printing apparatus.

It is another object of the present invention to provide a printing apparatus capable of imprinting non-round and irregularly shaped objects throughout the entire 360 degrees of peripheral surface, without requiring secondary printing cycles.

It is a further object of the present invention to provide a printing apparatus capable of imprinting non-round and irregularly shaped objects that include one or more flat panels, the flat panels being printable in the same printing cycle or pass-through as the non-round or irregularly shaped surfaces.

It is a still further object of the present invention to provide a printing apparatus and method for imprinting an object that includes a plurality of servo-motors, hydraulic actuators, or pneumatic actuators to operate the printing apparatus.

It is another object of the present invention to provide a printing apparatus and method for imprinting an object including both irregularly shaped or non-round objects and regularly shaped round and/or rectangular objects and combinations thereof in which a plurality of servo-motors are employed to control at least one of an object rotational position, a horizontal and vertical print screen position, a horizontal and vertical squeegee position, and a horizontal object position.

It is another object of the present invention to provide a printing apparatus in which a vertical distance between a print screen and a surface of an object to be imprinted is controlled by a servo-motor that is used to vertically position the object to be imprinted.

It is yet another object of the present invention to provide a printing apparatus in which a vertical distance between a print screen and surface of an object to be imprinted is controlled by a servo-motor used to vertically position a print screen/squeegee assembly of the printing apparatus.

It is another object of the present invention to provide a printing apparatus and method for imprinting an object including both irregularly shaped or non-round objects and regularly shaped round and/or rectangular objects and combinations thereof in which a plurality of servo-motors are employed to control a horizontal object position, a vertical object position, a rotational object position, and a horizontal squeegee position of the printing apparatus.

It is another object of the present invention to provide a printing apparatus and method for imprinting an object including both irregularly shaped or non-round objects and regularly shaped round and/or rectangular objects and combinations thereof in which a plurality of servo-motors are employed to control a horizontal object position, a vertical object position, a rotational object position, and a horizontal print-screen position of the printing apparatus.

It is another object of the present invention to provide a printing apparatus and method for imprinting an object including both irregularly shaped or non-round objects and regularly shaped round and/or rectangular objects and combinations thereof in which a plurality of servo-motors are employed to control a vertical object position, a rotational object position, a horizontal squeegee position and a horizontal print screen position.

It is another object of the present invention to provide a printing apparatus and method for imprinting an object including both irregularly shaped or non-round objects and regularly shaped round and/or rectangular objects and combinations thereof in which a plurality of servo-motors are employed to control a horizontal object position, a vertical object position, a rotational object position, a horizontal squeegee position and a horizontal print screen position.

It is a further object of the present invention to provide a printing apparatus and method for imprinting an object including both irregularly shaped or non-round objects and regularly shaped round and/or rectangular objects in combinations thereof in which a plurality of positioning vectors are utilized to control operation of the printing apparatus to effect imprinting of the object.

It is a further object of the present invention to provide a printing apparatus and method capable of imprinting an object having any of a large variety of regular or irregular geometric shapes, including rectangular, circular, elliptical, or any combinations thereof without complex mechanical linkages or cams and further to provide the capability to sequentially imprint a series of such objects having different geometric shapes without substantial modifications to the printing apparatus.

It is yet another object of the present invention to provide an electronic control unit for controlling a printing apparatus that includes a plurality of servo-motors, hydraulic actuators, or pneumatic actuators, used to control the printing apparatus.

It is yet another object of the present invention to provide an electronic control unit for controlling a printing apparatus that generates a plurality of positioning vectors used to control the printing apparatus.

It is a still further object of the present invention to provide an electronic control unit for controlling a printing apparatus in which data defining at least one object to be printed is stored in a look-up table within a memory of the electronic control unit.

It is another object of the present invention to provide an electronic control unit for controlling a printing apparatus in which data defining an object to be imprinted is diametrically calculated from a mathematical relationship defined in the object to be imprinted that is stored within the electronic control unit.

It is a still further object of the present invention to provide a printing apparatus having an electronic control unit associated therewith that allows an operator of the printing apparatus to quickly and easily select an object to be imprinted from a plurality of such objects that have data defining their geometric shapes stored within the electronic control unit.

These and other objects are satisfied in accordance with the present invention by the provision of a printing apparatus in which a plurality of servo-motors or other mechanical actuating devices are employed to control the position of the appropriate components of the printing apparatus to effect imprinting of an object having a desired form. The servo-motors are electrically controlled by an electronic control unit, such as a computer, to accurately control the position of the object to be printed with respect to a screen and squeegee of the printing apparatus. Control information is generated to control the relative displacement in a horizontal direction of a screen, a squeegee and an object to be imprinted Coy providing for the independent horizontal movement of (1) the screen and squeegee, (2) the squeegee and object to be imprinted, (3) the screen and the object to be imprinted, or (4) all of the screen, squeegee, and the object to be imprinted) and to control the vertical distance between the screen/squeegee assembly and the object to be imprinted Coy providing for the vertical movement of (1) the screen/squeegee assembly or (2) the object to be imprinted). The control information could be generated either mathematically according to the shape of the object to be imprinted or calculated and stored within a memory of the computer in the form of a look-up table. Therefore, in accordance with the present invention, a printing apparatus and method for imprinting both irregularly shaped or non-round objects and regularly shaped round and/or rectangular objects and combinations thereof is provided.

In a first preferred embodiment of the present invention, a printing apparatus is provided that includes a print screen fixed in at least the horizontal direction, a squeegee disposed adjacent to the print screen and movable in at least a horizontal direction, means for rotationally securing an object to be imprinted, such as an irregularly shaped or non-round bottle, about a center of rotation movable in at least a horizontal direction and disposed adjacent to the screen on a side opposite to the squeegee, and computer controlled servo-motors or other similar mechanical means for controlling the object's rotational position, the object's horizontal position, the screen's vertical position and the squeegee's horizontal and vertical position. In this first preferred embodiment, the screen and squeegee will move together in the vertical direction, and thus a first, single servo-motor can be used for this purpose. A second servo-motor is used to control the horizontal position of the squeegee. Finally, third and fourth servo-motors are used to independently control the rotational position of the object and the horizontal position of the object, respectively, which are controlled independently of each other.

In this first preferred embodiment, it is not necessary to provide for the horizontal movement of the screen. Furthermore, the required vertical relationship between the screen/squeegee assembly and the object to be imprinted is maintained through the vertical movement of the screen/squeegee assembly. In an equally preferred embodiment; the first servo-motor used to move the squeegee/screen assembly could be used instead to provide for vertical movement of the object to be imprinted. In such case, the screen and squeegee could be fixed in a vertical direction, leaving the squeegee movable only in the horizontal direction and the screen fixed in both the horizontal and vertical directions. In this regard, in accordance with this embodiment of the present invention, it is necessary only that the distance between the object to be imprinted and the screen surface be controlled, and such control can be accomplished by vertical movement of either the screen/squeegee assembly or the object to be imprinted.

In a second preferred embodiment of the present invention, a printing apparatus is provided that includes a screen movable in both a horizontal and vertical direction, a squeegee disposed adjacent to the screen and fixed in at least the horizontal direction, means for rotationally securing an object to be imprinted about a center of rotation movable in a horizontal direction and disposed adjacent to the screen on a side opposite to the squeegee, and computer controlled servo-motors or other similar mechanical means for controlling the object's rotational position, the object's horizontal position, the screen position and the squeegee's vertical position. In this second preferred embodiment, the screen and squeegee again will move together in the vertical direction, and thus a first, single servo-motor can be used for this purpose. A second servo-motor is used to control the horizontal position of the screen, with the squeegee being fixed in the horizontal direction in this embodiment. Finally, third and fourth servo-motors are used to independently control the rotational position of the object and the horizontal position of the object, respectively, which are controlled independently of each other.

In this second preferred embodiment, it is not necessary to provide for the horizontal movement of the squeegee. Furthermore, the required vertical relationship between the screen/squeegee assembly and the object to be imprinted is maintained through the vertical movement of the screen/squeegee assembly. In the alternative, as in the first preferred embodiment, the first servo-motor used to move the squeegee/screen assembly could again be used instead to provide for vertical movement of the object to be imprinted. In such case, the screen and squeegee could be fixed in a vertical direction, leaving the screen movable only in the horizontal direction and the squeegee fixed in both the horizontal and vertical directions.

In a third preferred embodiment of the present invention, a printing apparatus is provided that includes a screen movable in both a horizontal and vertical direction, a squeegee disposed adjacent to the screen and also movable in both a horizontal and vertical direction, means for rotationally securing an object to be imprinted about a fixed center of rotation disposed adjacent to the screen on a side opposite to the squeegee, and computer controlled servo-motors or other similar mechanical means for controlling the object's rotational position, the screen position and the squeegee position. In this third preferred embodiment, the screen and squeegee will move together in the vertical direction, and thus a first, single servo-motor can be used. Second and third servo-motors are used to control the horizontal position of the screen and the squeegee, respectively, which are moved independently of each other.

Finally, a fourth servo-motor is provided to control the rotational position of the object to be imprinted.

In this third preferred embodiment, it is not necessary to provide for the movement, either horizontally or vertically, of the object to be imprinted. The required vertical relationship between the screen/squeegee and the object to be imprinted is maintained through the vertical movement of the screen/squeegee assembly. As above, in the alternative, the first servo-motor used to move the squeegee/screen could be used instead to provide for vertical movement of the object to be imprinted. In such case, the screen and squeegee could be fixed in a vertical direction. Again, it is merely necessary that the distance between the object to be imprinted and the screen surface be controlled, and such control can be accomplished by vertical movement of either the screen/squeegee assembly or the object to be imprinted.

Finally, in a fourth preferred embodiment of the present invention, a printing apparatus is provided that includes a screen movable in both a horizontal and vertical direction, a squeegee disposed adjacent to the screen and also movable in both a horizontal and vertical direction, means for rotationally securing an object to be imprinted about a center of rotation movable in at least a horizontal direction and disposed adjacent to the screen on a side opposite to the squeegee, and computer controlled servo-motors or other similar mechanical means for controlling the object's rotational position, the object's horizontal position, the screen position and the squeegee position.

In this fourth preferred embodiment, the screen and squeegee will move together in the vertical direction, and thus a first, single servo-motor can be used. Second and third servo-motors are used to control the horizontal position of the screen and the horizontal position of the squeegee, respectively, which are moved independently of each other.

A fourth servo-motor is provided to control the rotational position of the object to be imprinted and a fifth servo-motor is provided to control the horizontal position of the object to be imprinted.

In this fourth preferred embodiment, none of these components of the printing apparatus remain in a fixed position—rather all of these components are moveable in at least some respect. As described above in connection with the first, second and third preferred embodiments, such movement is not absolutely necessary in order to effect printing of an object. However, due to practical considerations affecting the acceleration and jerk of the movable components, the provision of an additional servo-motor can be desirable. That is, in the first, second and third preferred embodiments discussed above, any two of the squeegee, print screen or object to be imprinted are movable in a horizontal direction. However, if insufficient acceleration can be achieved in this manner, the addition of the ability to move the third of these components can overcome this difficulty and thereby increase the printing speed of the apparatus. Furthermore, as in the above embodiments, the required vertical relationship between the screen/squeegee and the object to be imprinted can be maintained either through the vertical movement of the screen/squeegee assembly or through the vertical movement of the object to be imprinted, or both should it be necessary.

DETAILED DESCRIPTION OF PREFERRED EMBODIMENTS

Figure 1A:
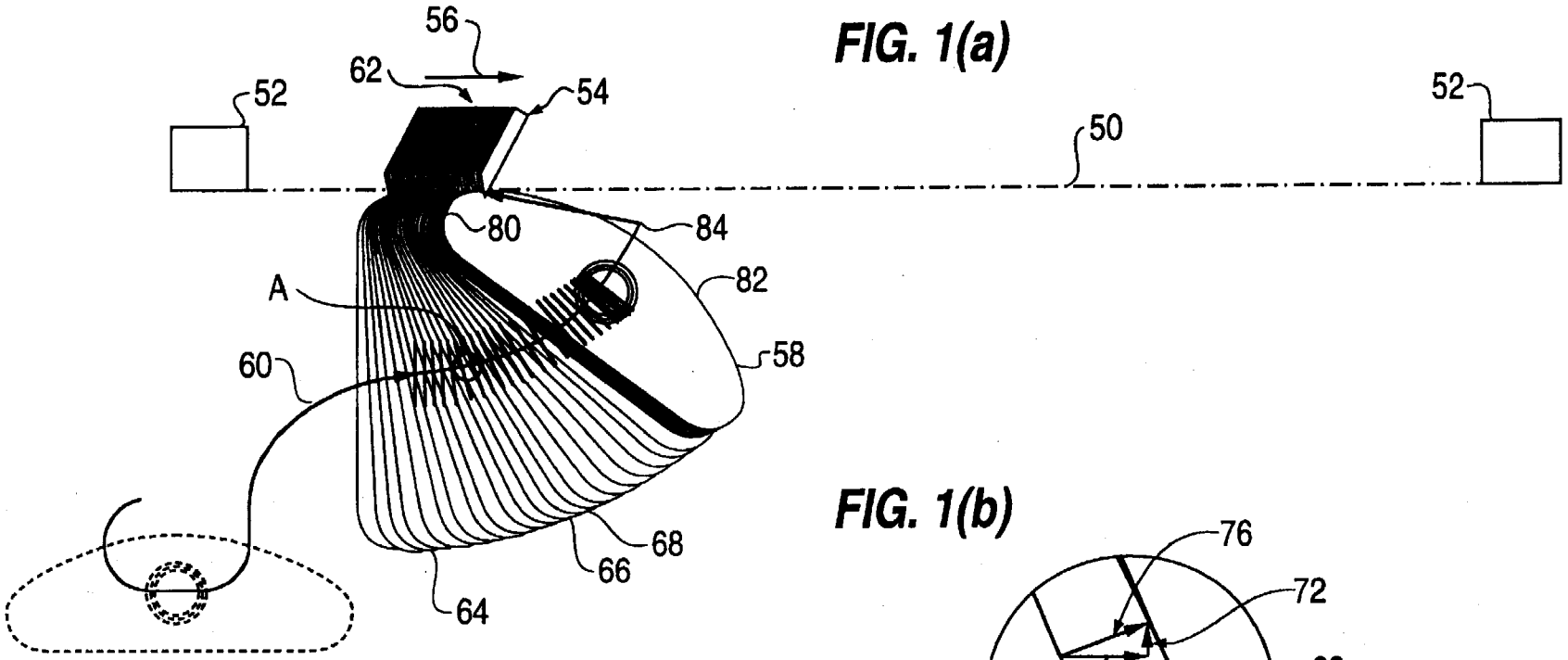
FIGS. 1(*a*) and 1(*b*) illustrate the general concept of vector positioning in a printing apparatus of the present invention and the movement of the relevant components through a time sequence illustration depicting a plurality of positions of a squeegee and object to be imprinted during a portion of the printing process.
Figure 1B:
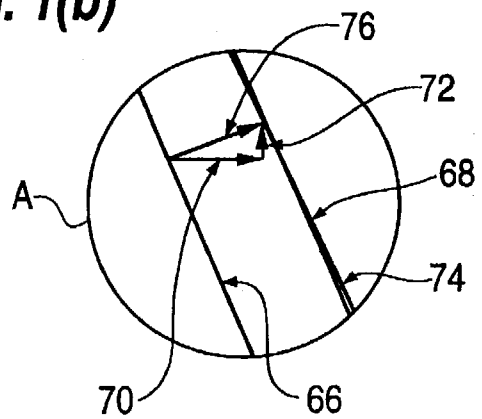

Referring first to FIGS. 1(*a*) and 1(*b*), the general concept of vector positioning in a printing apparatus and the movement of the relevant components of the present invention is shown through a time sequence illustration depicting a plurality of positions of a squeegee and object to be imprinted during a portion of the printing process. FIGS. 1(*a*) and 1(*b*) are generally directed to the first preferred embodiment of the invention described above in which a squeegee and object to be imprinted are movable in a horizontal position and the object is further movable in the vertical direction. Thus, the screen remains fixed in both the vertical and horizontal directions and the squeegee remains fixed in the vertical direction. Although specifically directed to the first preferred embodiment, the concepts discussed in connection with FIGS. 1(*a*) and 1(*b*) are equally applicable to all of the preferred embodiment discussed above.

As seen in FIG. 1(*a*), print screen 50 is fixedly secured to supports 52, which are secured in the printing apparatus by means not shown in FIG. 1(*a*). In this embodiment, print screen 50 is fixed from movement in either the horizontal or vertical directions. Disposed adjacent to print screen 50 is squeegee 54, which generally moves horizontally during the printing process in the direction of arrow 56. Object 58 is disposed adjacent to print screen 50 on a side opposite to that of the squeegee 54, and follows a path indicated generally by line 60. During the progression of the printing process, squeegee 54 and object 58 each assume a plurality of corresponding positions, generally indicated at 62 and 64 respectively.

Referring next to FIG. 1(*b*), the portion indicated at A in FIG. 1(*a*) is shown in more detail, illustrating a single incremental move in the printing process of the object to be imprinted. As seen in FIG. 1(*b*), the object to be imprinted progresses from a first position 66 to a second position 68. This movement includes three independent components—a first horizontal movement indicated by vector 70; a second vertical movement indicated by vector 72; and a third rotational movement across angle 74. Vector 70 and vector 72 are combined to form resultant vector 76, which represents the combination of the horizontal and vertical components of the desired incremental movement.

In operation, as described in more detail below, object 58 will be vertically moved as indicated by vector 72 by a first servo-motor (or other suitable mechanical means such as a hydraulic or pneumatic device) and will be horizontally moved as indicated by vector 70 by a second servo-motor or other mechanical device. A third servo-motor is used to control the rotational angle 74 of the object and a fourth servo-motor is used to horizontally position squeegee 54 as required. As is clear from FIGS. 1(*a*) and 1(*b*), squeegee 54 moves across a generally constant predetermined horizontal distance during each step of the printing process. In order to ensure that an accurate image is imprinted on object 58, it is necessary that the same linear distance on the surface of object 58 be positioned adjacent to squeegee 54 during this increment. Therefore, vectors 70 and 72 (and thus resultant vector 76), and rotational angle 74 should be selected so as to result in this condition being satisfied.

The above condition is particularly difficult to satisfy where object 58 has an external surface having a varying geometric shape. Specifically, where object 58 has an external surface that is comprised of portions having different radii, special care must be taken in determining the incremental parameters necessary to ensure that the linear distance across which squeegee 54 is incremented equals that across which the external surface of object 58 is incremented. A further important aspect of the present invention is the ability to handle such circumstances and to easily maintain the continuity of the printing operation across a point of inflection in object 58. Specifically, as seen in FIG. 1(*a*), object 58 could include a first, small radius portion 80 and a second large radius portion 82. During the printing operation, for each incremental move 62 of squeegee 54, resultant vector 76 and rotation angle 74 are determined depending on the geometric properties of the portion of object 58 that is directly adjacent to squeegee 54.

That is, when small radius portion 80 of object 58 is directly adjacent to squeegee 54, resultant vector 76 and rotation angle 74 will be substantially as shown in FIG. 1(*b*). However, when large radius portion 82 of object 58 is directly adjacent to squeegee 54, resultant vector 76 and rotation angle 74 will be reduced. This results since a smaller angular rotation of object 58 is required to provide the same linear distance corresponding to the incremental move 62 of squeegee 54 when large radius portion 82 is being imprinted. Furthermore, this smaller angular rotation results in a smaller vertical vector component as well as a smaller horizontal vector component, thus reducing the overall magnitude of the resultant vector. This change is illustrated in FIG. 1(*a*) by the relative change in movement of object 58 that occurs at the point of inflection 84.

In operation the positioning devices are controlled such that a smooth transition occurs through each of the above-described movements. That is, the object rotational movement 74 is smoothly transistioned during the same time period that the object resultant vector movement 76 and the incremental squeegee movement are completed. Therefore, the relative velocity of the movement of each of these components could vary as necessary to ensure a smooth transition across the desired movement distance.

Figure 2:
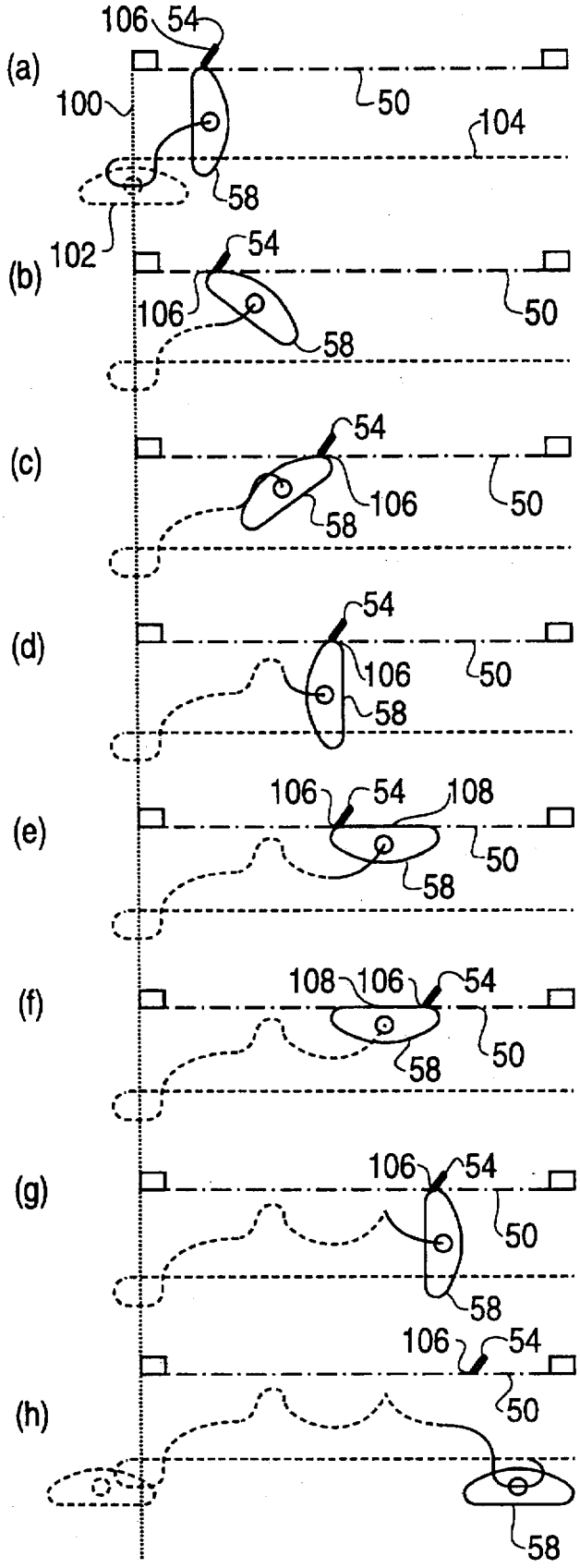
FIGS. 2(*a*)–2(*h*) illustrate the relative movement of an object to be imprinted with respect to a print screen and print squeegee in more detail in accordance with the first preferred embodiment of the present invention.

Referring next to FIGS. 2(*a*)–2(*h*), the relative movement of an object to be imprinted with respect to a print screen and print squeegee is shown in more detail in accordance with the first preferred embodiment of the present invention. As noted above, in this embodiment, the print screen 50 remains in a fixed position relative to the base printing apparatus, as represented by line 100. Generally, in FIGS. 2(*a*)–2(*h*), the object 58 to be imprinted is indicated by a solid line at its current position. The path of the object to reach that position (the current move) is also shown as a solid line, while all previous movement paths are shown as a phantom line.

As seen in FIG. 2(*a*), by line 104, the return of the object carriage following the completion of the imprinting process of the previous object is illustrated. During this return of the object carriage, application of ink to the screen 50 for imprinting of the next object can be performed if necessary. After the object carriage returns and the application of ink to screen 50 is complete, the object 58 to be imprinted is retrieved from a loading position 102 and initially moved to a beginning printing position as shown in FIG. 2(*a*). Also, squeegee 54 is positioned adjacent to object 58 on an opposite side of print screen 50 adjacent a contact point 106 between object 58 and screen 50.

Thereafter, as shown in FIGS. 2(*b*)–2(*h*), the object 58 generally progresses through horizontal movement from left to right. Furthermore, in connection with this movement, object 58 is rotated and a vertical offset between the object 58 and the print screen 50 is controlled to ensure that contact point 106 at which printing is to occur remains directly adjacent to screen 50. As noted above, the control of this vertical offset can be accomplished either by controlling the vertical position of object 58, which is illustrated in FIGS. 2(*a*)–2(*h*), or by controlling the vertical position of the print screen 50 and squeegee 54.

Squeegee 54 moves in a generally horizontal direction from left to right in a manner such that squeegee 54 is directly opposite contact point 106 at which printing is to occur. In some instances, as is readily apparent from the above description and as illustrated in FIGS. 2(*e*) and 2(*f*), object 58 will have little or no movement, but squeegee 54 will undergo substantial horizontal movement. As is clear from FIG. 2, such situation typically arises when object 58 has a substantially flat portion, such as portion 108 shown in FIGS. 2(*e*) and 2(*f*) in contact with screen 50. Finally, upon completion of the printing process, object 58 is moved to an unloading position, where it is removed from the object carriage. Thereafter, with the return of the object carriage and application of ink to the print screen 50, the printing process repeats to imprint additional objects.

Importantly, as shown in FIGS. 2(*a*)–2(*h*), squeegee 54 and the center of rotation of the object 58 generally move to the right during the printing process, although at different rates. In operation, squeegee 54 will move relative to print screen 50 at an approximately uniform speed and the object 58 will be moved accordingly to follow the line of contact between the print screen 50 and squeegee 54. In this embodiment, it is further important to note that the general movement of the object 58 is from left to right and, as illustrated below, does not generally include reciprocal, or retrograde, motion in a horizontal direction. The detailed construction of a printing apparatus for performing the print operation illustrated in FIG. 2 is described in detail below in connection with FIGS. 5–8.

Figure 3:
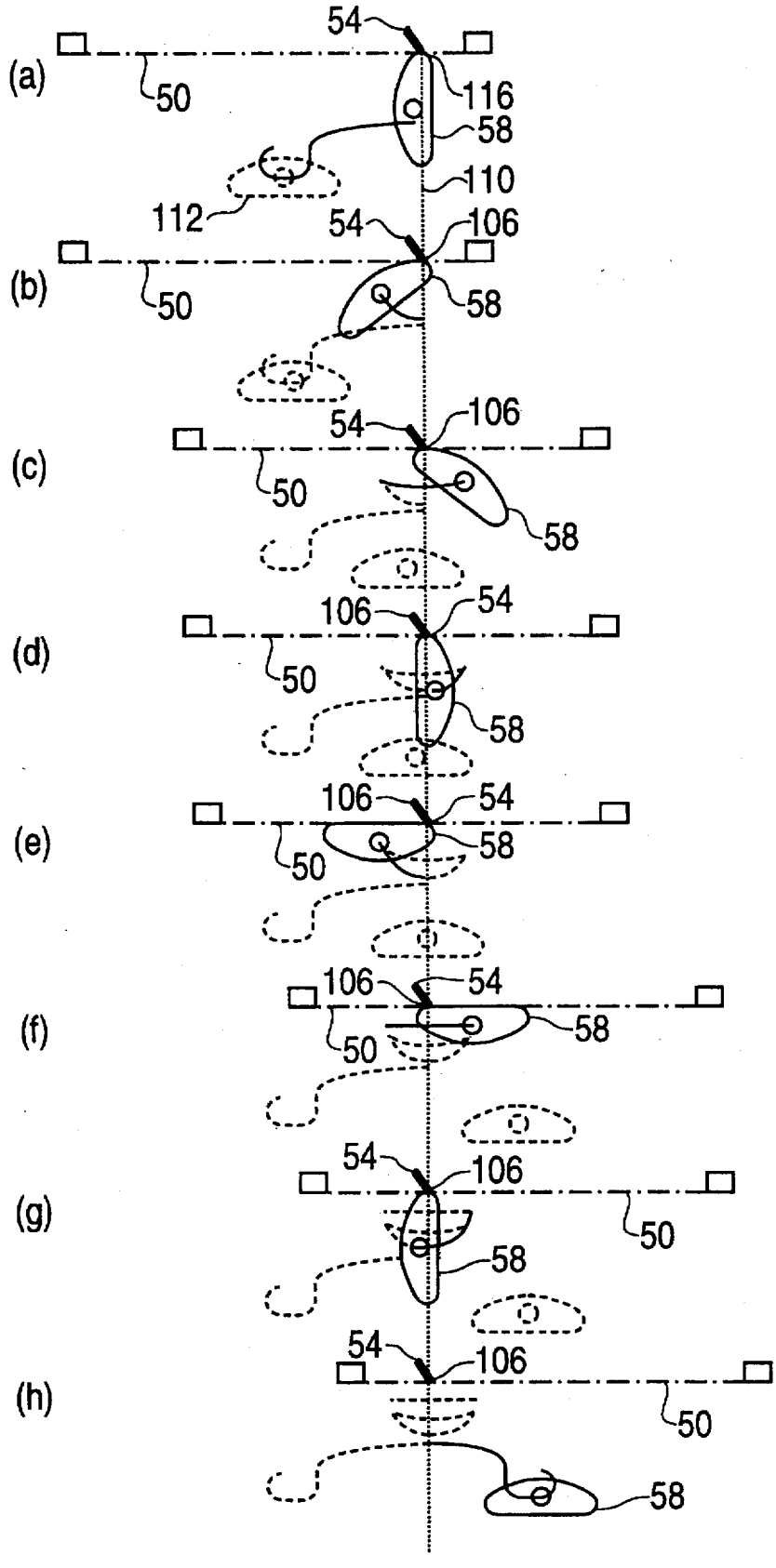
FIGS. 3(*a*)–3(*h*) illustrate the relative movement of an object to be imprinted with respect to a print screen and print squeegee in more detail in accordance with the second preferred embodiment of the present invention.

Referring next to FIGS. 3(*a*)–3(*h*), the relative movement of an object to be imprinted with respect to a print screen and print squeegee is shown in more detail in accordance with the second preferred embodiment of the present invention. In this embodiment, the squeegee 54 remains in a fixed position relative to the base printing apparatus as represented by line 110. As with FIG. 2, in FIGS. 3(*a*)–3(*h*), the object 58 to be imprinted is indicated by a solid line at its current position. The path of the object to reach that position (the current move) is also shown as a solid line, while all previous movement paths are shown as a phantom line.

As seen in FIG. 3(*a*), the object 58 to be imprinted is retrieved from a loading position 112 and initially moved to a beginning printing position. Also, print screen 50 is horizontally positioned to the left so that the corresponding starting point on print screen 50 is aligned with squeegee 54, which is held adjacent a contact point 116 between object 58 and screen 50. Of course, in the alternative, print screen 50 could initially be moved to the right with corresponding left hand (rather than right hand) movement during the printing process described below.

Thereafter, as shown in FIGS. 3(*b*)–3(*h*), the print screen 50 generally progresses horizontally from left to right in a manner such that the appropriate portion of print screen 50 is adjacent object 58 and squeegee 54 at contact point 106 at which printing is to occur. Furthermore, in connection with this movement, object 58 is rotated and a vertical offset between the object 58 and the print screen 50 is controlled to ensure that a point 106 at which printing is to occur is directly adjacent to screen 50. As noted above, the control of this vertical offset can be accomplished either by controlling the vertical position of object 58, which is illustrated in FIGS. 3(*a*)–3(*h*), or by controlling the vertical position of the print screen 50 and squeegee 54.

In this embodiment, the printing of a relatively flat portion of object 58 is accomplished through simultaneous movement of both print screen 50 and object 58 as illustrated in FIGS. 3(*e*) and 3(*f*) at a substantially uniform speed. Finally, upon completion of the printing process, object 58 is moved to an unloading position, where it is removed from the object carriage. Thereafter, with the return of print screen 50 to the left and application of ink to the print screen 50, the printing process repeats to imprint additional objects.

Importantly, as shown in FIGS. 3(*a*)–3(*h*), print screen 50 generally moves to the right during the printing process. In operation, print screen 50 will move relative to squeegee 54 at an approximately uniform speed and the object 58 will be moved accordingly such that the appropriate portion of object58 to be imprinted is adjacent the contact point between the squeegee 54 and the print screen 50. In this embodiment, it is further important to note that unlike the first preferred embodiment, the path of object 58, as illustrated, necessarily includes both left and right, or retrograde, movements. Therefore, although this embodiment allows the squeegee to remain fixed, for certain applications, this complex movement of object 58 may make this embodiment of the present invention more or less preferred.

Figure 4:
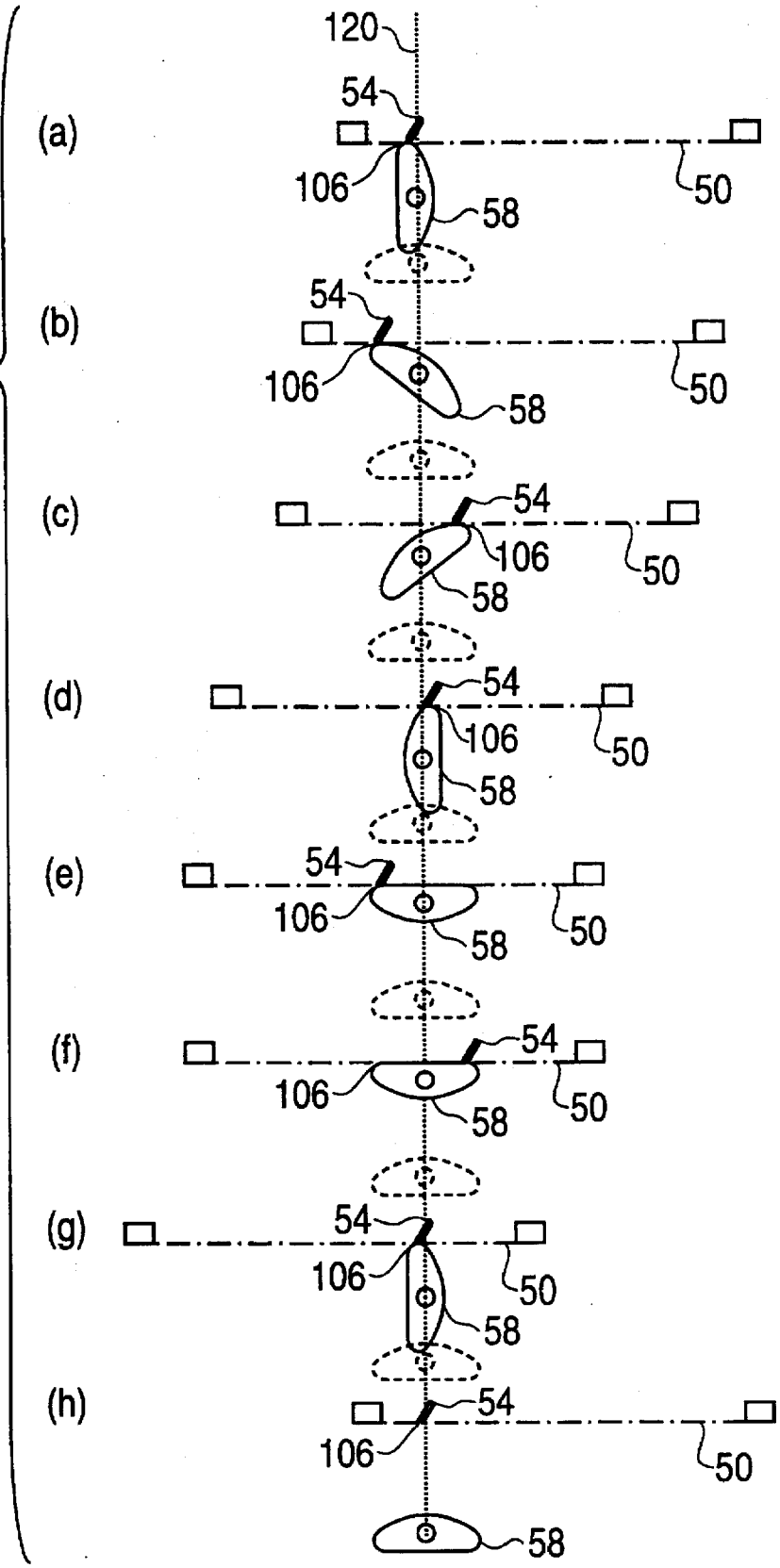
FIGS. 4(*a*)–4(*h*) illustrate the relative movement of an object to be imprinted with respect to a print screen and print squeegee in more detail in accordance with the third preferred embodiment of the present invention.

Referring next to FIGS. 4(*a*)–4(*h*) the relative movement of a print screen and print squeegee with respect to an object to be imprinted is shown in accordance with the third preferred embodiment of the present invention in a manner similar to that shown in FIGS. 2 and 3. In this embodiment, the center of rotation for the object 58 to be imprinted is fixed from motion in a horizontal direction relative to the base printing apparatus as illustrated by line 120.

As seen in FIG. 4(*a*), the object 58 to be imprinted is retrieved from a loading position and moved to a beginning printing position. Also, print screen 50 is horizontally positioned to a start position, in this example to the right so that the corresponding starting point on print screen 50 is aligned with squeegee 54, which is held adjacent a contact point 106 between object 58 and screen 50.

Thereafter, as shown in FIGS. 4(*b*)–4(*h*), the print screen 50 generally progresses horizontally from right to left in a manner such that the appropriate portion of print screen 50 is adjacent object 58. Also, squeegee 54 moves relative to both object 58 and print screen 50 so that squeegee 54 remains adjacent contact point 106 between object 58 and print screen 50 at which printing is to occur.

Furthermore, as in the earlier described embodiment, object 58 is rotated and a vertical offset between the object 58 and the print screen 50 is controlled to ensure that a point 106 at which printing is to occur is directly adjacent to screen 50. As noted above, the control of this vertical offset can be accomplished either by controlling the vertical position of object 58, which is illustrated in FIGS. 4(*a*)–4(*h*), or by controlling the vertical position of the print screen 50 and squeegee 54.

In this third preferred embodiment, the printing of a relatively flat portion of object 58 requires only movement of squeegee 54 as illustrated in FIGS. 4(*e*) and 4(*f*), since the flat portion of object 58 can be positioned directly adjacent to and in contact with print screen 50. Finally, upon completion of the printing process, object 58 is moved to an unloading position, where it is removed from the object carriage. Thereafter, with the return of print screen 50 to the right and application of ink to the print screen 50, the printing process repeats to imprint additional objects.

In this embodiment, print screen 50 generally moves to the left during the printing process. In operation, print screen 50 will move relative to object 58 at an approximately uniform speed and squeegee 54 will be moved to the left or right as required to follow the contact point 106 between the object 58 and the print screen 50 adjacent to squeegee 54. In this embodiment, it is further important to note that the required movement of squeegee 54 is generally limited to a fixed distance to the left or right of line 120 about which the position of object 58 is fixed. Furthermore, the amount of required movement of squeegee 54 can be limited to that necessary to imprint the widest portion of object 58. That is, squeegee 54 need only have the ability to move across a distance substantially the same as the widest portion of the object 58 to be imprinted. The path of squeegee 54, however, includes both left and right, or retrograde, movements and the velocity of squeegee 54 relative to print screen 50 must be nearly constant. Therefore, for certain applications, this movement of squeegee 54 may make this embodiment of the present invention more or less preferred.

Figure 5:
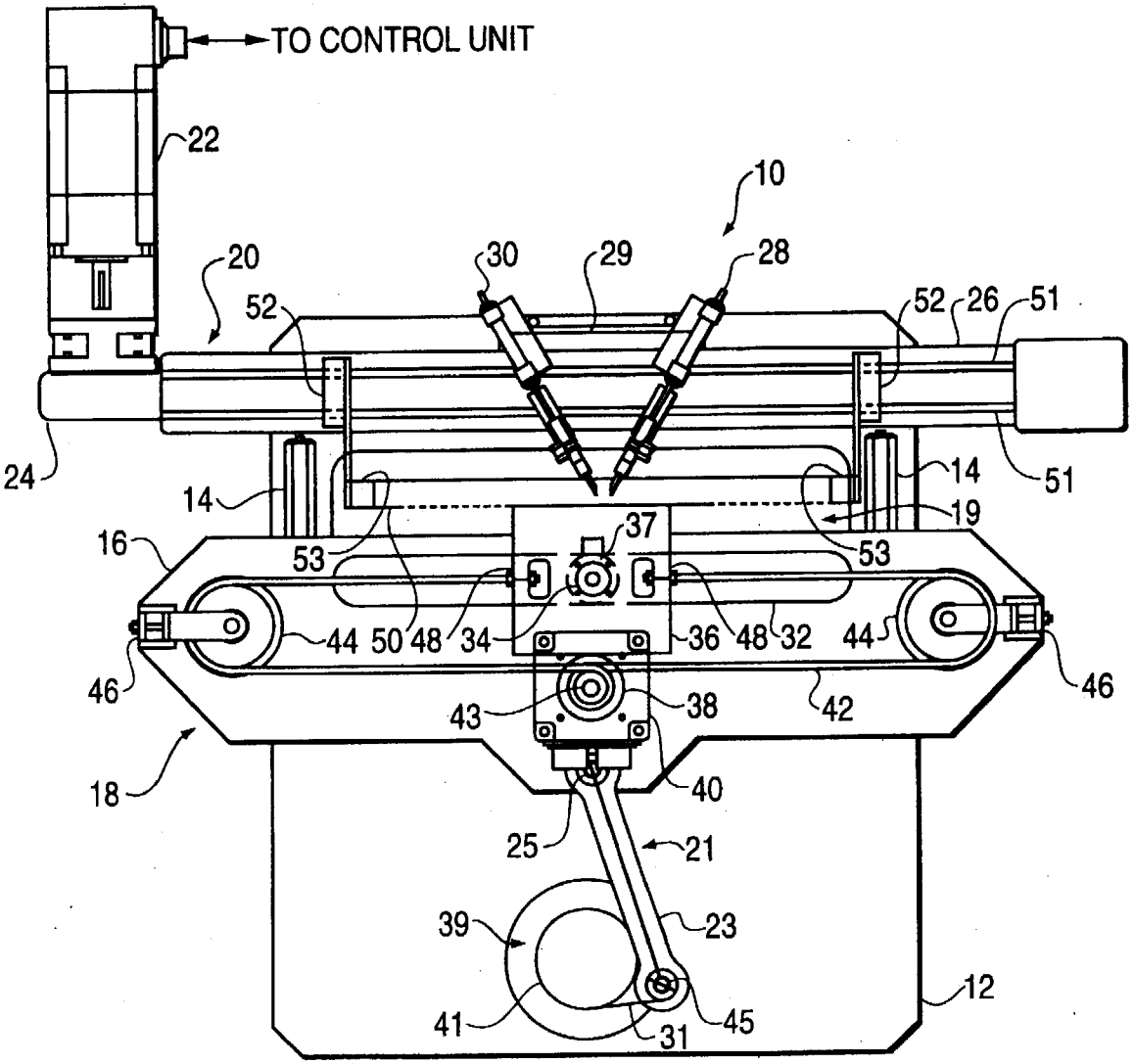
FIG. 5 depicts a front view of a printing apparatus in accordance with a first preferred embodiment of the present invention.
Figure 6:
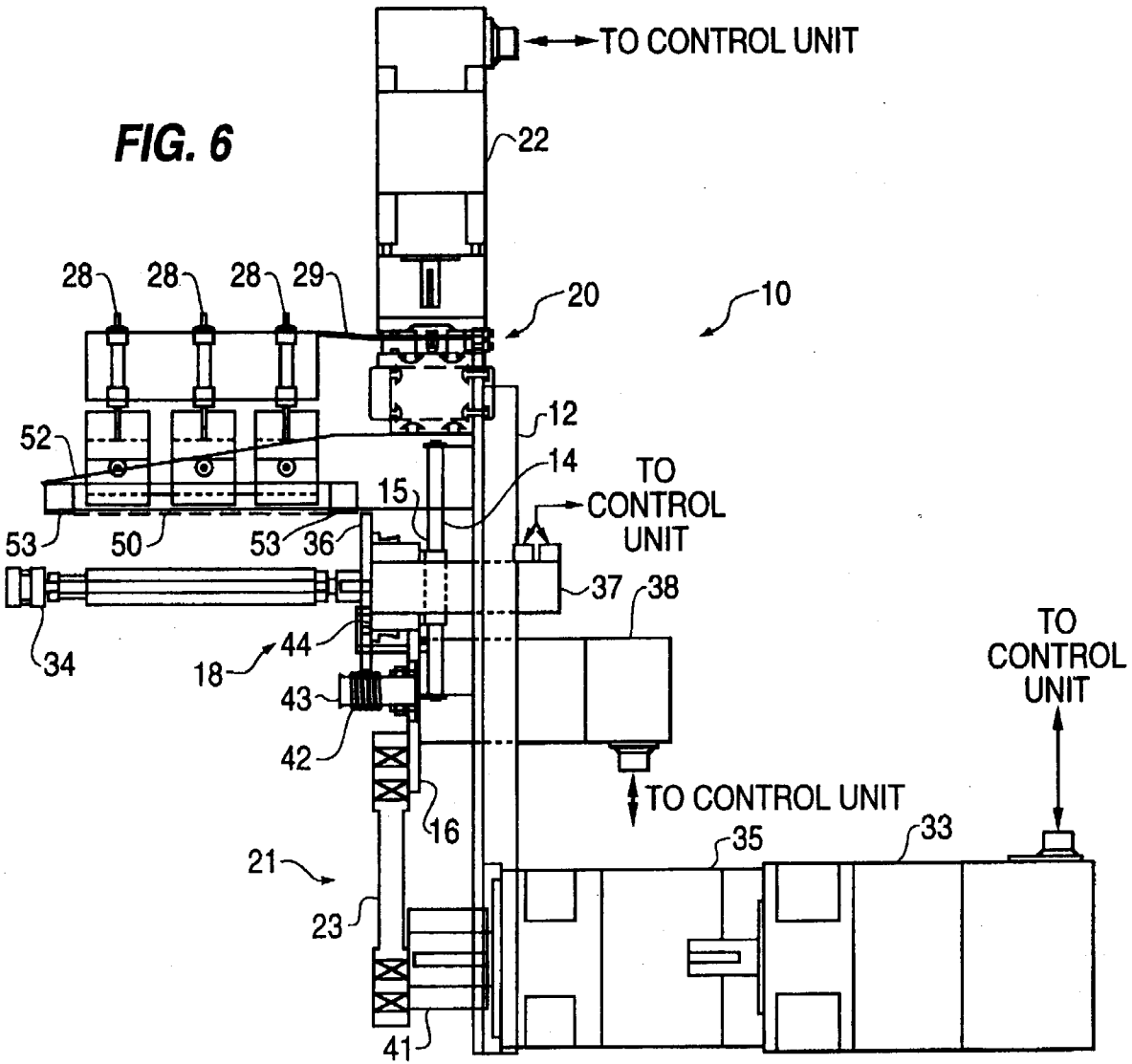
FIG. 6 depicts a side view of the printing apparatus shown in FIG. 5 in accordance with a first preferred embodiment of the present invention.
Figure 7:
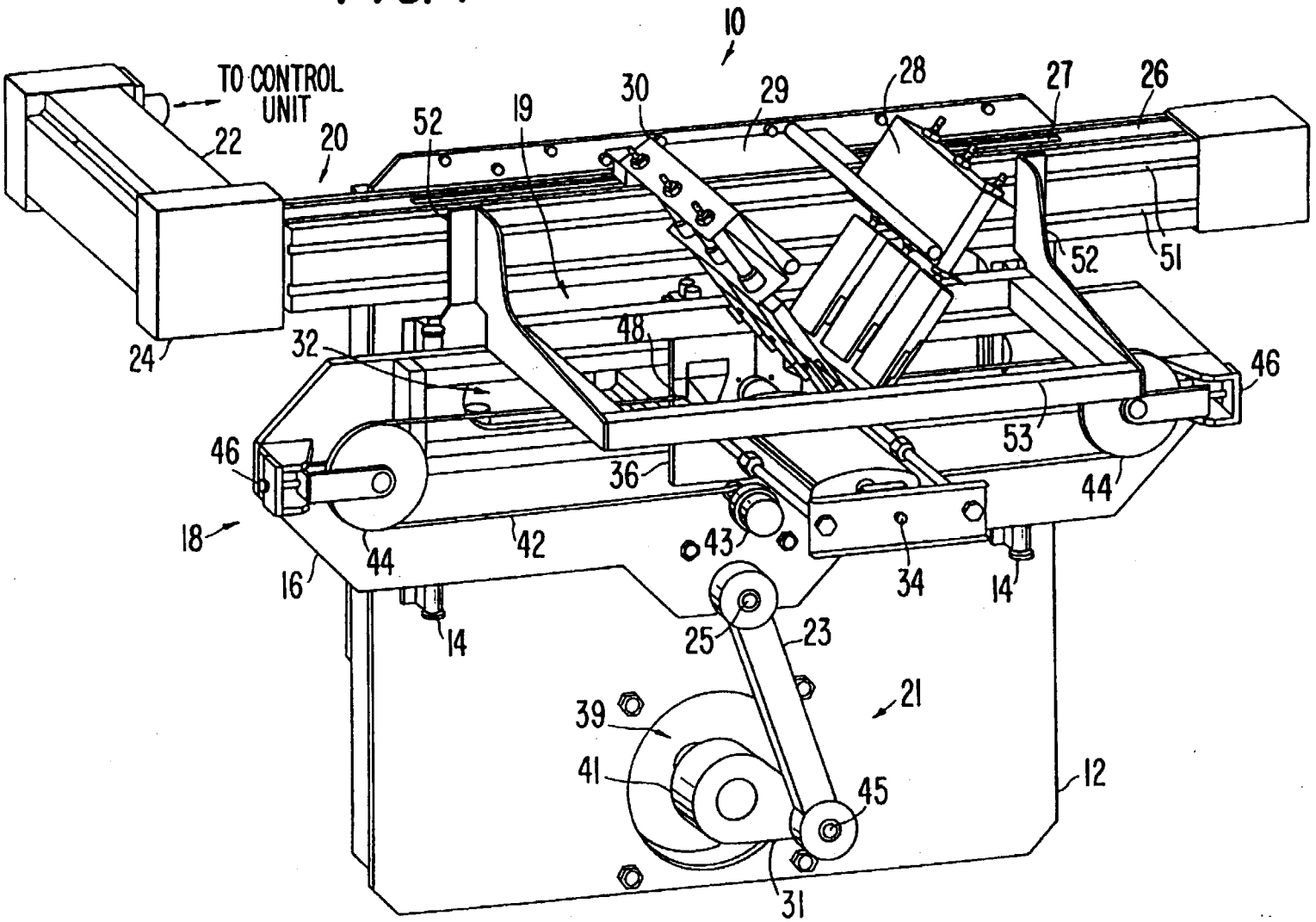
FIG. 7 illustrates a from perspective view of the printing apparatus 10 shown in FIGS. 5 and 6 in accordance with a first preferred embodiment of the present invention.
Figure 8:
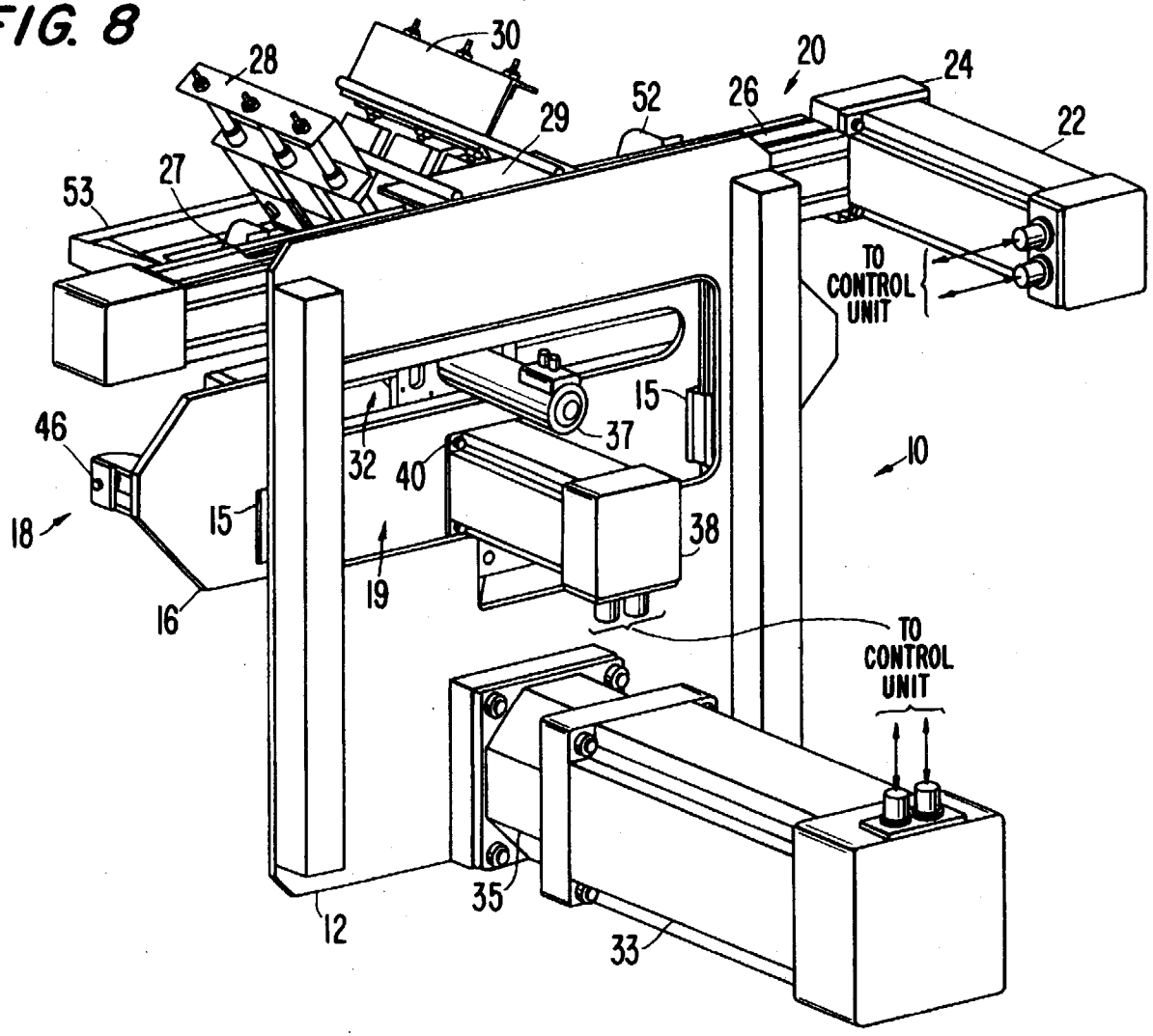
FIG. 8 illustrates a rear perspective view of the printing apparatus shown in FIGS. 5–7 in accordance with a first preferred embodiment of the present invention.

Having generally described the principles of operation of the present invention above, a detailed description of a printing apparatus suitable for performing such operation is now discussed. Referring generally to FIGS. 5–8, a printing apparatus 10 in accordance with the first preferred embodiment of the present invention having a fixed print screen is shown. Specifically, FIG. 5 depicts a front view of the printing apparatus 10; FIG. 6 depicts a side view thereof; FIG. 7 illustrates a front perspective view thereof; and FIG. 8 illustrates a rear perspective view thereof. In these Figures, like reference numerals are used for like components.

As seen in these Figures, printing apparatus 10 generally includes a fixed backplane 12, which could be attached to or integral with a frame of the printing apparatus 10. Attached to backplane 12 are rails 14, which extend in a substantially vertical direction with respect to backplane 12. Rails 14 slidably engage a mounting mechanism 15 attached to plate 16 of object positioning assembly 18. Object positioning assembly 18 is further attached to backplane 12 through vertical drive mechanism 21. In this manner, object positioning assembly 18 can freely move in a vertical direction with respect to backplane 12. Backplane 12 includes an opening 19 formed therein through which various components of object positioning assembly 18 extend, as described below. Also attached to backplane 12 is squeegee positioning assembly 20, which is generally positioned above both rails 14 and object positioning assembly 18 near the top of backplane 12.

In this embodiment, print screen 50 (not shown in FIGS. 7 and 8) is rigidly attached to backplane 12 of the printing apparatus 10 by means of supports 52 that connect to print screen frame 53. Supports 52 engage slots 51 in horizontal rail 26 to fix print screen frame 53 and thus print screen 50 in position. In this first preferred embodiment, print screen 50 is fixed from movement by supports 52 in both the horizontal and vertical directions.

Squeegee positioning assembly 20 includes a squeegee positioning servo-motor 22, a squeegee transmission 24, and horizontal rail 26 having a horizontal slot 27 formed therein. A squeegee assembly 28 and a flood bar assembly 30 are slidably attached to horizontal rail 26 through mounting assembly 29 that interfaces with horizontal slot 27 in a manner to permit horizontal movement of squeegee assembly 28 and a flood bar assembly 30 with respect thereto. In operation, one of squeegee assembly 28 and flood bar assembly 30 are selectively positioned to an operational position directly adjacent to screen 50. As is well known, flood bar assembly 30 is used to apply ink to print screen 50 just prior to the printing process, while squeegee assembly 28 is used to force ink through the print screen 50 during the printing process.

Squeegee positioning servo-motor 22 is operatively connected with squeegee transmission 24 and squeegee transmission 24 is further operatively connected with mounting assembly 29. When operated, squeegee positioning servo-motor 22 transfers power through squeegee transmission 24 to mounting assembly 29, thus resulting in horizontal movement of mounting assembly 29. Although not shown in detail in FIG. 5, any suitable mechanical interconnection between squeegee transmission 24 and mounting assembly 29 can be used such as, for example, a cable and pulley mechanism that is well known in the art. Furthermore, the precise orientation of squeegee positioning servo-motor 22 is not critical. As shown in FIGS. 5 and 6, squeegee positioning servo-motor 22 could be orientated in a substantially vertical direction or, as shown in FIGS. 7 and 8, squeegee positioning servo-motor 22 could be orientated in a substantially horizontal direction with equal effect.

As noted above, object positioning assembly 18 includes plate 16, which slidably mates to backplane 12 through rails 14. Plate 16 includes an opening 32 through which an object carriage assembly 34 extends and connects at the rearward portion thereof to an object rotation servo-motor 37. Object carriage assembly 34 extends through and is connected for conjoint movement with plate 36, which is slidably engaged by suitable mounting means for horizontal movement with respect to opening 32.

The horizontal position of plate 36 is controlled by horizontal positioning servo-motor 38, which is secured to plate 16 for integral movement therewith by mounting bracket 40. Cable 42 connects with spindle 43 of horizontal positioning servo-motor 38 and extends around pulleys 44 to connect to opposite sides of plate 36 via cable connectors 48. Pulleys 44 may be connected to plate 16 using connection assemblies 46 or other suitable mechanical devices. When horizontal positioning servo-motor 38 is operated, resulting in rotation of spindle 43, cable 42 horizontally reciprocates about pulleys 44 thereby positioning plate 36.

Vertical drive mechanism 21 includes connecting arm 23 pivotably attached to plate 16 at pivot point 25 and further pivotably attached to cam wheel 41 at pivot point 45. Cam wheel 41 has an offset portion 31 including pivot point 45. Thus, rotation of cam wheel 41 results in movement of connecting arm 23 and thus in vertical movement of plate 16 along rails 14. Rotation of cam wheel 41 and thus vertical motion of plate 16 is controlled by vertical motion servo-motor 33. Vertical drive servo-motor 33 is connected to vertical drive transmission 35, which is operatively connected to cam wheel 41 through opening 39 in backplane 12.

Vertical drive transmission 35 is used in this first preferred embodiment of the present invention to control the actuation force generated by vertical drive servo-motor 33 and transferred to cam wheel 41. Specifically, it is noted that less than one full rotation and as little as approximately 60 degrees of rotation of cam wheel 41 is needed for the full range of required vertical motion. In contrast, object rotation servo-motor 37, horizontal positioning servo-motor 38 and squeegee positioning servo-motor 22 all require greater rotational movement in operation. Furthermore, it is noted that vertical positioning servo-motor 33 must accurately position the entire object positioning assembly 18, which can have substantial weight. Therefore, the use of vertical drive transmission 35, which preferably serves to reduce the output of vertical drive servo-motor 33, further acts to ensure that sufficient force is provided for accurate movement of the object positioning assembly 18.

From the above description, it is apparent that any suitable servo-motor or other mechanical actuator can be used in accordance with the present invention. It will be readily understood that any such actuator capable of providing sufficient performance characteristics (i.e. response time, acceleration, velocity, accuracy, etc.) can be used. Accordingly, the specific selection of an appropriate actuator can be made by one of skill in the art based on the size of the printing apparatus and the desired printing characteristics (such as speed, size of object, etc.)

As described above, squeegee positioning servo-motor 22 and horizontal positioning servo-motor 38 operate independent of each other to control the position of squeegee assembly 28 and object carriage assembly 34 respectively. In an alternative embodiment of this first preferred embodiment, both squeegee assembly 28 and object carriage assembly 34 could be carded on a single positioning mechanism and relative movement of squeegee assembly 28 with respect to the object to be imprinted further provided for by a separate squeegee positioning assembly that is moved together therewith. That is, it is only necessary for squeegee assembly 28 to provide for movement of the squeegee relative to the object to be imprinted. Therefore, squeegee assembly 28 could provide for differential movement of the squeegee with respect to the object to be imprinted with a first servo-motor, and this entire assembly could be transported with the object to be imprinted by a second servo-motor, such as horizontal positioning servo-motor 38. While this alternative somewhat simplifies the required squeegee movement, the mass of the system to be moved by horizontal positioning servo-motor 38 is increased. Therefore, in certain circumstances this embodiment may be more or less preferred.

Figure 9:
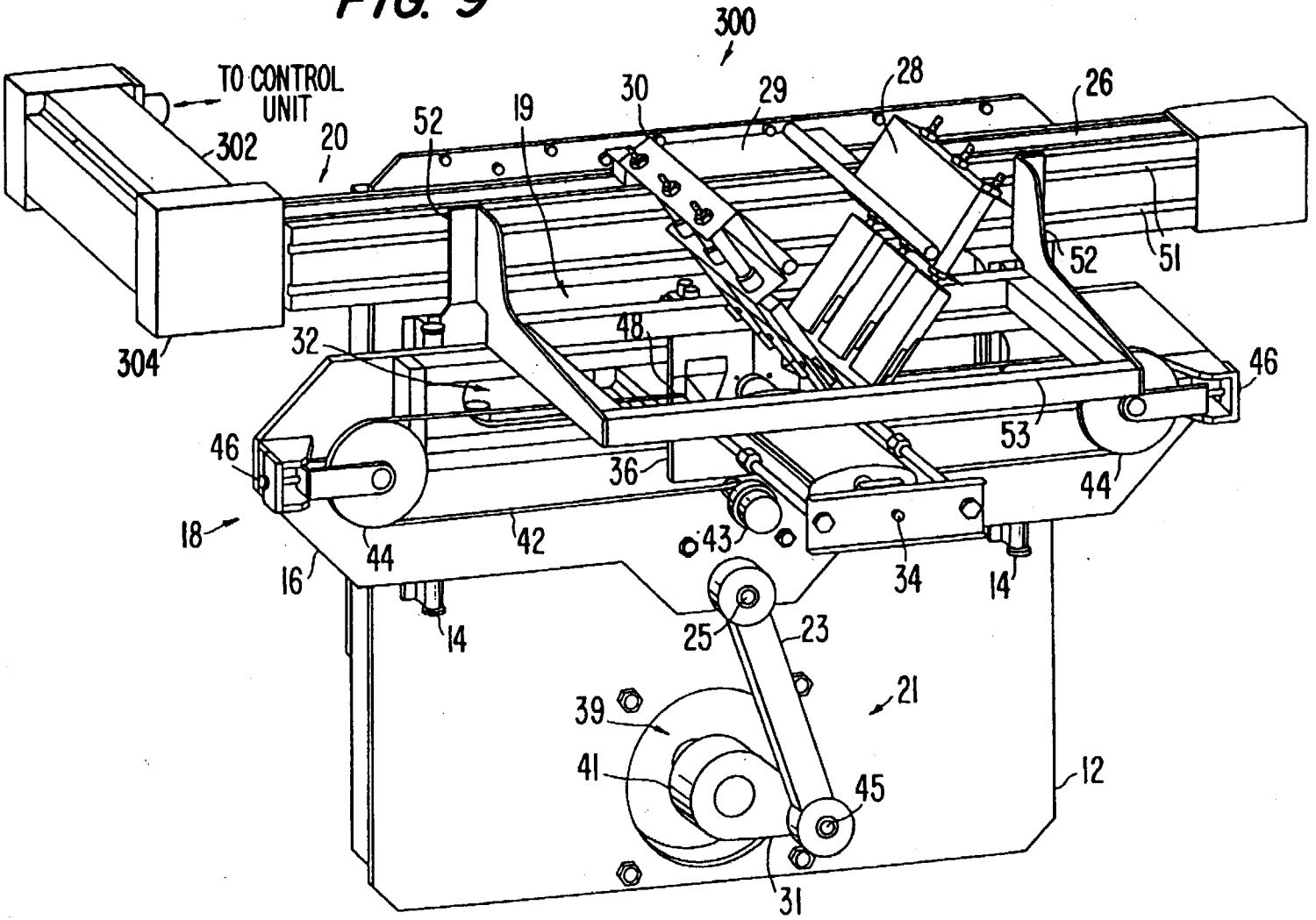
FIG. 9 illustrates a perspective view of a printing apparatus in accordance with a second preferred embodiment of the present invention.

Referring next to FIG. 9, a printing apparatus 300 in accordance with the second preferred embodiment of the present invention is shown. As can be seen, FIG. 9 corresponds substantially to FIG. 7, except that squeegee assembly 28 and a flood bar assembly 30 are fixed with respect to the printing apparatus and the print screen held by print screen frame 53 and attached to horizontal rail 26 by supports 52 is moveable in a horizontal direction. Again, like reference numerals are used for similar components.

The printing apparatus 300 shown in FIG. 9 is suitable for carrying out the printing method depicted in FIG. 3 discussed above. As seen in FIG. 9, horizontal slot 27 for receiving mounting assembly 29 to permit horizontal movement of squeegee assembly 28 is not required in that squeegee assembly 28 (and hence flood bar assembly 30) are fixed in horizontal position in this embodiment. Furthermore, squeegee positioning servo-motor 22 and squeegee transmission 24 are replaced by a print screen positioning servo-motor 302 and print screen transmission 304, which are located in substantially the same position as squeegee positioning servo-motor 22 and squeegee transmission 24. In practice, print screen positioning servo-motor 302 and print screen transmission 304 could be the same servo-motor and transmission used for the squeegee.

Print screen servo-motor 302 controls the horizontal position of print screen frame 53, and thus print screen 50, using any suitable mechanical interconnection between the print screen transmission 304 and print screen frame 53 such as, for example, a cable and pulley mechanism that is well known in the art. Such mechanism could pass through the center of horizontal rail 26 and connect to supports 52 to achieve slidable movement of supports 52 in slots 51. Of course, any other suitable mechanism for achieving the desired horizontal movement of the print screen frame 53 could be used as will be readily apparent to one of skill in the art.

The operation of the printing apparatus by the control unit, such as the electronic control unit described below, will also need to be modified in order to properly control the print screen position instead of the squeegee position. In practice, such changes will likely be made in software, with the provision of an updated or revised control program for the control unit. In other respects, the second preferred embodiment of the present invention shown in FIG. 9 is substantially identical to that shown in FIG. 7 and thus like reference numerals are used.

Figure 10:
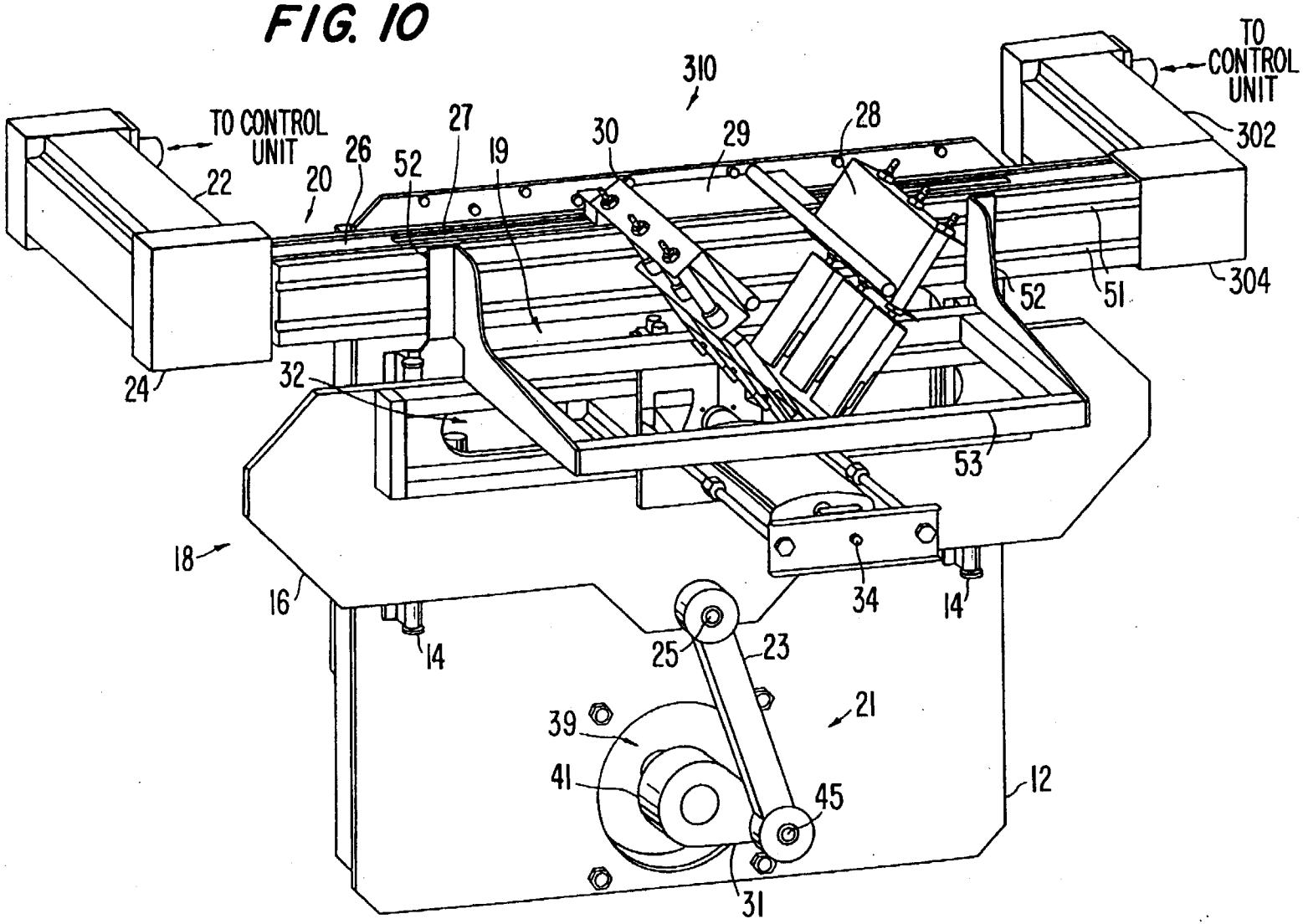
FIG. 10 illustrates a perspective view of a printing apparatus in accordance with a third preferred embodiment of the present invention.

Referring next to FIG. 10, a printing apparatus 310 in accordance with the third preferred embodiment of the present invention is shown. As can be seen, FIG. 10 corresponds substantially to FIGS. 7 and 9, except that print screen positioning servo-motor 302 and print screen transmission 304, have been moved to an opposite end of horizontal rail 26, and the mechanism for horizontal movement of the object to be imprinted is no longer necessary and therefore has been removed. Squeegee positioning servo-motor 22 and squeegee transmission 24 remain in the same position as shown in FIG. 7 and are similarly used to control the horizontal position of squeegee assembly 28 as in the first preferred embodiment. The printing apparatus shown in FIG. 10 is suitable for carrying out the printing method depicted in FIG. 4 discussed above.

As in the second preferred embodiment shown in FIG. 9, print screen servo-motor 302 controls the horizontal position of print screen frame 53, and thus print screen 50, using any suitable mechanical interconnection between the print screen transmission 304 and print screen frame 53 such as, for example, a cable and pulley mechanism that is well known in the art. Such mechanism could pass through the center of horizontal rail 26 in a manner so as not to interfere with the squeegee positioning assembly and connect to supports 52 to achieve slidable movement of supports 52 in slots 51. Of course, any other suitable mechanism for achieving the desired horizontal movement of the print screen frame 53 could be used in this embodiment as well.

Finally, as in the second preferred embodiment, the operation of the printing apparatus by the control unit, such as the electronic control unit described below, will also need to be modified in order to properly control both the print screen position and the squeegee position instead of just one of these positions in combination with the object horizontal position. Again, such changes will likely be made in software, with the provision of an updated or revised control program for the control unit. In other respects, the third preferred embodiment of the present invention shown in FIG. 10 is substantially identical to that shown in FIGS. 7 and 9 and thus like reference numerals are used.

Figure 11:
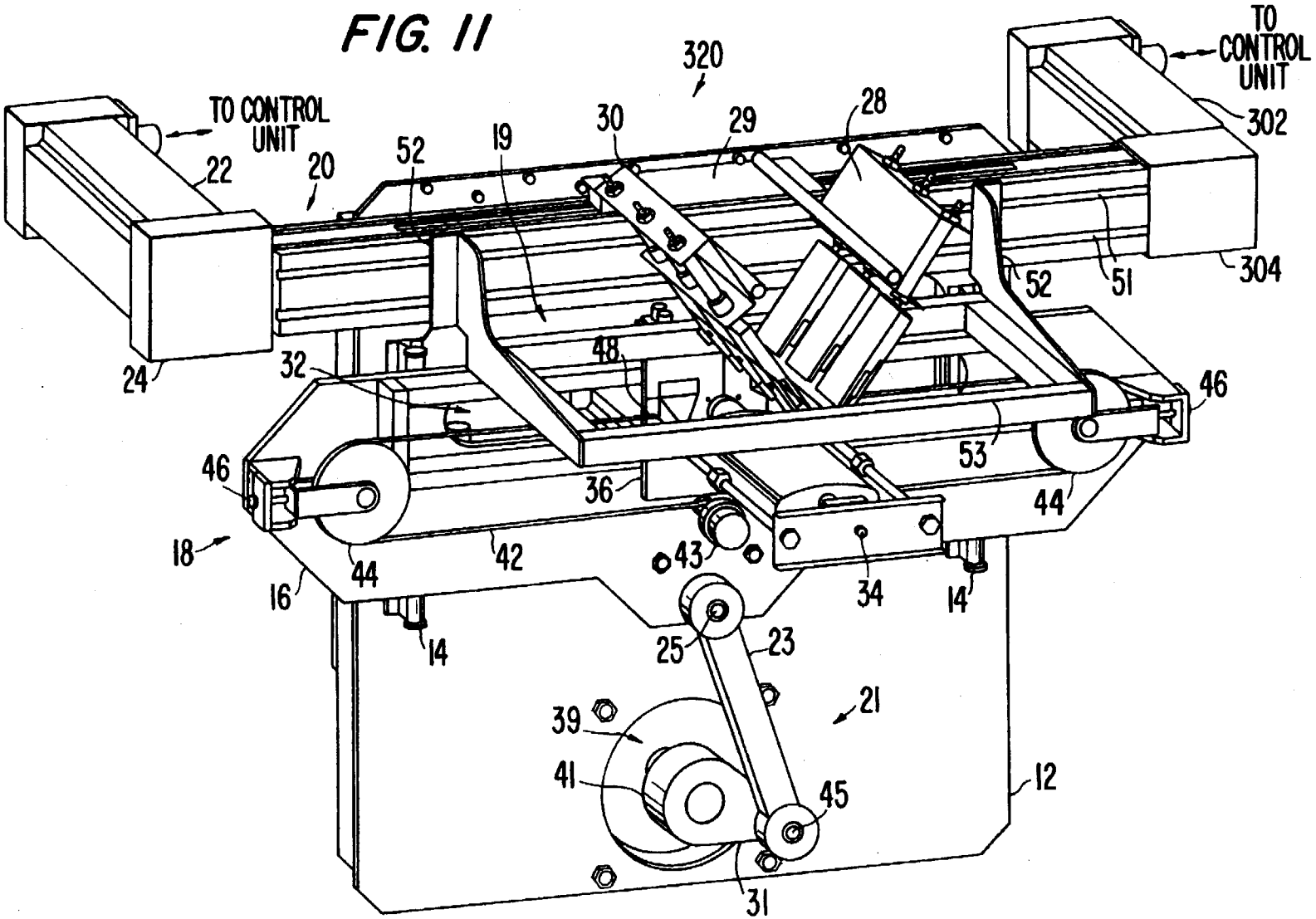
FIG. 11 illustrates a perspective view of a printing apparatus in accordance with a fourth preferred embodiment of the present invention.

FIG. 11 illustrates the fourth preferred embodiment of the printing apparatus in accordance with the present invention as discussed above. In the fourth preferred embodiment, a printing apparatus 320 is provided that includes a print screen 50 movable in a horizontal direction, a squeegee assembly 28 also movable in a horizontal direction, and an object positioning assembly 18 for horizontally positioning the object to be imprinted. In this regard, the fourth preferred embodiment shown in FIG. 11 includes servo-motors for controlling the horizontal position of all three of these components and thus is similar to the first preferred embodiment with the addition of print screen positioning servo-motor 302 and print screen transmission 304 as shown in FIG. 10.

As noted above, this embodiment of the printing apparatus is particularly advantageous due to practical considerations affecting the acceleration and jerk of the movable components. That is, in the first, second and third preferred embodiments discussed above, any two of the squeegee, print screen or object to be imprinted are movable in a horizontal direction. However, if insufficient acceleration can be achieved in this manner, the addition of the ability to move the third of these components can be desirable.

Finally, as in the above embodiments, the operation of the printing apparatus by the control unit, such as the electronic control unit described below, will again need to be modified in order to properly control the print screen position, the squeegee position and the object horizontal position. In other respects, the third preferred embodiment of the present invention shown in FIG. 8 is substantially identical to that shown in FIGS. 7 and 10, and thus like reference numerals are used.

As noted above, the required vertical relationship between the screen/squeegee assembly and the object to be imprinted in the present invention can be maintained through either the vertical movement of the object to be imprinted or through the vertical movement of the screen/squeegee assembly. In this regard, in accordance with the present invention, it is necessary only that the distance between the object to be imprinted and the screen surface be controlled, and such control can be accomplished by vertical movement of either the screen/squeegee assembly or the object to be imprinted.

Figure 12:
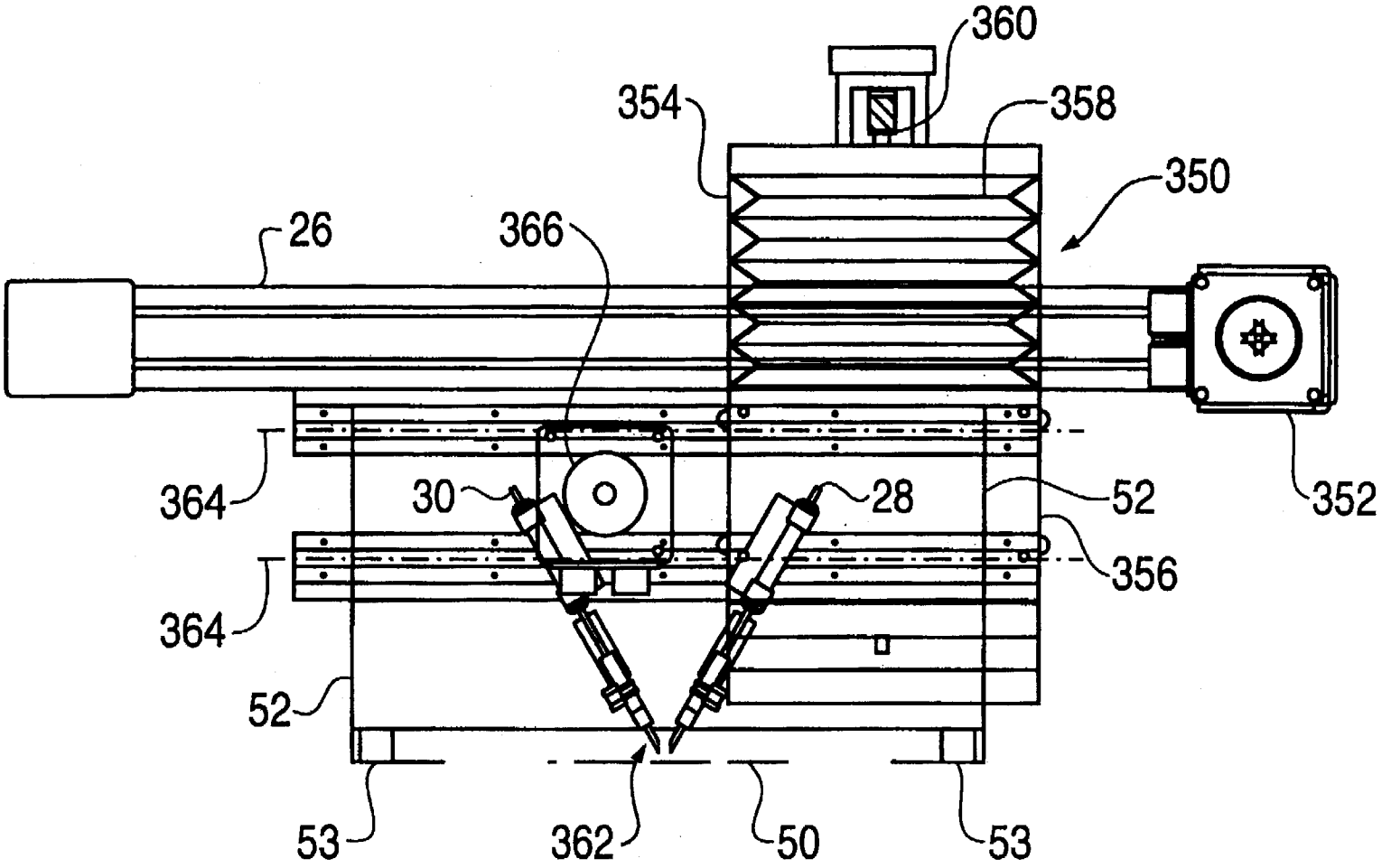
FIG. 12 illustrates an alternative embodiment of the present invention in which the print screen/squeegee assembly is moved in a vertical direction to control the vertical relationship between a print screen/squeegee assembly and an object to be imprinted.

The first, second, and third preferred embodiments previously discussed were primarily directed to an embodiment wherein the vertical relationship is maintained by the movement of the object to be imprinted. Referring to FIG. 12, an alternative embodiment in which the print screen/squeegee assembly is moved to control this vertical relationship is shown. The vertical position assembly of the alternative embodiment shown in FIG. 12 could be used with any of the previously discussed embodiments as will be readily understood by one of skill in the art from the following description.

As seen in FIG. 12, horizontal rail 26 now carries a vertical positioning assembly 350, which is itself positioned in a horizontal direction by a horizontal positioning servo-motor 352 or other suitable mechanical actuator connected to horizontal rail 26 in a manner similar to that discussed above in connection with squeegee positioning servo-motor 22. Vertical drive plate 354 is attached to horizontal rail 26 in a slidable relationship and further interconnected with horizontal positioning servo-motor 352 through suitable mechanical means to permit horizontal movement along horizontal rail 26, such as a cable-pulley mechanism or the like.

Mounted on vertical drive plate 354 for slidable movement therewith is horizontal mounting plate 356. Horizontal mounting plate 356 is adapted for movement in a vertical direction (perpendicular to the axis of horizontal rail 26) along vertical drive plate 354 through suitable mechanical means (not shown) such as a rail assembly. Furthermore, bellows 358 house a vertical positioning servo-motor 360 that is rigidly connected with vertical drive plate 354 for conjoint movement therewith and is connected with horizontal mounting plate 356 through a suitable mechanical interconnection to permit vertical movement of horizontal mounting plate 356 with respect to vertical drive plate 354. Thus, the combination of horizontal positioning servo-motor 352 and vertical positioning servo-motor 360 enable both horizontal and vertical movement of horizontal mounting plate 356.

As seen in FIG. 12, print screen 50 is rigidly attached to horizontal mounting plate 356 through print screen frame 53 and supports 52. A squeegee/flood bar assembly 362 is further provided and is adapted for further horizontal movement with respect to print screen 50. That is, in order to provide for relative movement between the print screen 50 and squeegee/flood bar assembly 362, rails 364, or other suitable mechanical means, are provided that slidably engage with squeegee/flood bar assembly 362 to permit horizontal movement with respect to horizontal mounting plate 356. Furthermore, a squeegee servo-motor 366, which may be substantially identical to squeegee servo-motor 22 shown in FIGS. 5–8, is connected with squeegee/flood bar assembly 362 in a manner to provide for horizontal movement thereof.

As is clear from the above description, in operation, vertical positioning servo-motor 360 controls the vertical position of horizontal mounting plate 356 and thus controls the vertical position of both squeegee/flood bar assembly 362 and print screen 50. Therefore, this apparatus or a variation thereof can be used to control the vertical relationship between an object to be imprinted and the print screen/squeegee assembly as an alternative to the vertical positioning of the object itself, as described above in the first, second and third preferred embodiments.

As seen in FIGS. 5–8, object rotation servo-motor 37, horizontal positioning servo-motor 38, squeegee positioning servo-motor 22 and vertical drive servo-motor 33 are all connected to a control unit that provides control information to the servo-motors. The control unit is most preferably an electronic control unit that includes a micro-controller, microprocessor, programmable logic controller, or the like and associated circuitry for supplying suitable control signals to the servo-motors.

Figure 13:
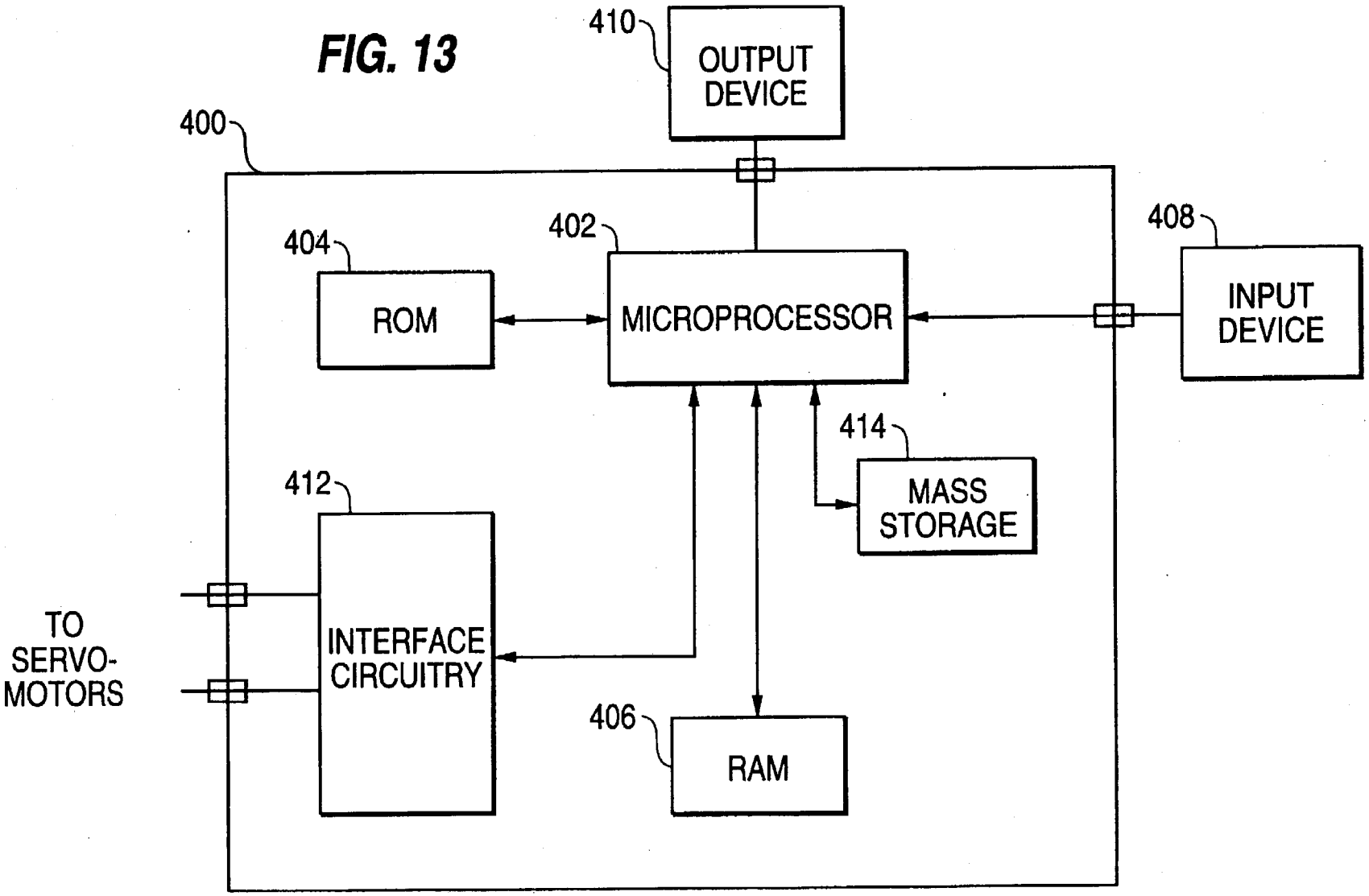
FIG. 13 illustrates a schematic block diagram of one example of an electronic control unit that could be used in accordance with the present invention.

Referring to FIG. 13, a schematic block diagram of one example of an electronic control unit 400 that could be used in accordance with the present invention is shown. As noted above, electronic control unit 400 most preferably includes a micro-controller, microprocessor, programmable logic controller, or the like and in this example, a microprocessor 402 is illustrated. Electronic control unit 400 preferably includes one or both of a read-only memory 404 or a random access memory 406 for storing commands for controlling the operation of electronic control unit 400 as described in more detail below in connection with FIGS. 14 and 15. Furthermore, electronic control unit 400 preferably includes a reprogrammable memory, such as random access memory 406 for storing information defining the object to be imprinted. That is, data defining the parameters necessary to control the servo-motors shown in FIGS. 5–8 for a specific object to be imprinted is preferably stored within electronic control unit 400 in such a manner that it can be easily modified.

Electronic control unit 400 also preferably has associated therewith an input device 408 such as a keyboard or mouse for receiving input from a user of the electronic control unit 400, and an associated display terminal 410, such as a video display terminal, for displaying information to the user. Electronic control unit 400 could be, for example, a standard IBM compatible personal computer having appropriate software operating therein.

Electronic control unit 400 also includes interface circuitry 412, as required, to interface to the servo-motors of the printing apparatus. Control signals are sent from electronic control unit 400 to the servo-motors or other positioning devices in any suitable format as required by the positioning device in use. For example, if a selected servo-motor can receive RS-232 serial commands, a standard serial port on a personal computer could be used as interface circuitry 412 to control such servo-motor. Of course, any other required communication standard (and corresponding interface circuitry 412) could be employed with equal effectiveness in the present invention as is readily apparent to one of skill in the art. Furthermore, if desired, feedback signals from the servo-motors can be received by electronic control unit 400 to indicate, for example, the current position of the servo-motor or other positioning device, or any other suitable parameters concerning the operation of the servo-motor that is to be processed by the electronic control unit.

As described in more detail below, electronic control unit 400 operates to calculate the desired movement of the components of the printing apparatus that are under servo-motor control and to generate appropriate control signals in response to the desired movements. In making such calculations, electronic control unit 400 requires information defining the object to be imprinted. Such information could be calculated before the printing process and stored as a data file (such as a look-up table) in a memory, such as random access memory 406, of electronic control unit 400, or could be dynamically calculated by the central processor, such as microprocessor 402, of electronic control unit 400 through the provision of an appropriate mathematical equation defining the object to be printed. Of course, as is readily apparent to one of skill in the art, additional factors (such as the acceleration, jerk and latency of the positioning devices, the resolution of print desired, the speed of printing required, the weight and size of the object to be imprinted, etc.) can be compensated for as required by the electronic control unit 400, most preferably through altering software used to control the operation of electronic control unit 400.

In any event, the electronic control unit preferably maintains several data sets or equations for objects and permits the user to simply select the appropriate object to be printed from a list of those available. In this manner, a given object need only be defined once, and is preferably stored in nonvolatile storage 414, such as a mass storage device, within electronic control unit 400 until it is next desired to imprint an object corresponding to that data set.

Figure 14:
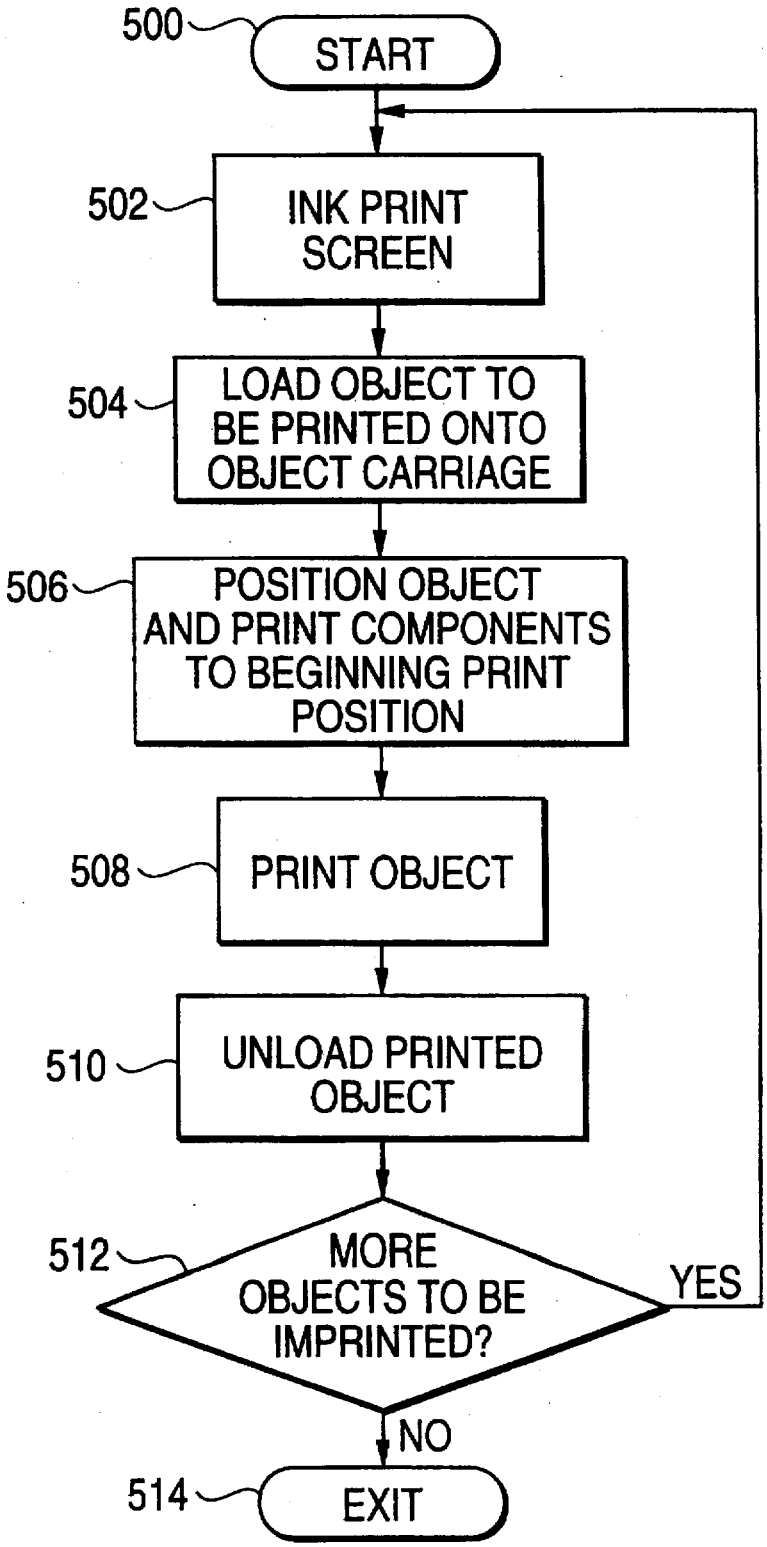
FIG. 14 shows a flowchart broadly illustrating a method of printing an object in accordance with the present invention in which a printing apparatus in accordance with the present invention is used.

Referring next to FIG. 14, a flowchart broadly depicting the steps performed by a printing apparatus in accordance with present invention is shown. In the most preferred embodiment of the present invention, these steps would be performed by electronic control unit 400 shown in FIG. 13 through the generation of servo-motor control information and by providing such information to appropriate servo-motors of the printing apparatus. As seen in FIG. 14, the process begins at block 500. The electronic control unit first sends appropriate commands to ink the print screen if necessary in block 502. These commands could include a command to position flood bar assembly 30 to an operational position directly adjacent to the print screen and to transition flood bar assembly across the print screen to ensure uniform application of ink thereto.

Next, in block 504, electronic control unit 400 loads an object to be imprinted onto an object carriage assembly. Electronic control unit 400 generates servo-motor control information to position the object carriage assembly to a predetermined object loading position. Thereafter, an object is received by the object carriage assembly and secured thereto by, for example, a command from electronic control unit 400 to operate a pneumatic clamp cylinder that forms a part of the object carriage assembly.

Next, in block 506, electronic control unit 400 positions the object and print components to the beginning print position. Depending on the particular embodiment of the present invention, differing print components are under electronic control, and thus respond to such positioning commands. For example, if the printing apparatus is configured in accordance with the first preferred embodiment (having a fixed print screen) then the squeegee, is positioned directly adjacent to the object to be imprinted. If the printing apparatus is of the second preferred embodiment (having a fixed squeegee) then the print screen is appropriately positioned. Similarly, if the print apparatus is of the third preferred embodiment, both the print screen and the squeegee are positioned, while only the object rotational position is adjusted. In the fourth preferred embodiment, all of these items (print screen, squeegee and object position) are properly positioned. Finally, the vertical position of the object to be imprinted is adjusted by either movement of the object itself, or movement of the print screen/squeegee assembly as described above.

Next, in block 508, the object is printed. Again, depending on the embodiment of the print apparatus being used, differing control information must be provided to the servo-motors or other position devices used in the printing apparatus to effect printing of the object. For each of the varying configurations of the print apparatus of the present invention, these steps are described in detail below in connection with FIG. 15.

After completion of the printing process, the imprinted object is unloaded in block 510 and the electronic control unit then checks to see if additional objects are to be imprinted in block 512. If so, the process returns to block 502 to ink the print screen (if necessary) and repeats the printing process. If no additional objects remain to be imprinted, the process exits at block 514.

Figure 15:
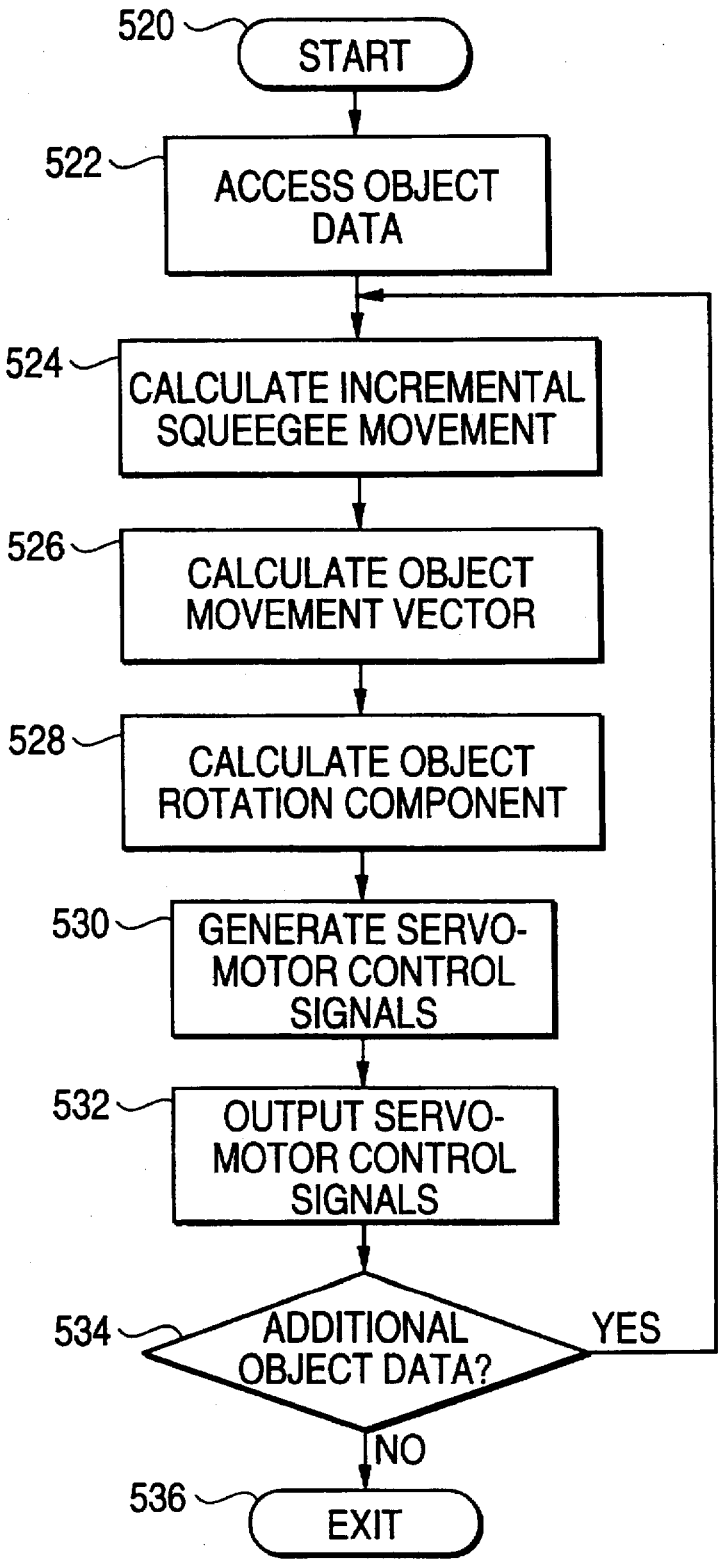
FIG. 15 illustrates in more detail the method of printing an object shown in FIG. 14.

FIG. 15 illustrates in more detail the steps of block 508 performed by electronic control unit 400 in accordance with the first preferred embodiment of the present invention. The process begins in block 520 and accesses object data in block 522. The object data may be, for example, a look-up table stored in a memory in electronic control unit 400 that includes numerical data representative of the object to be imprinted, or could include input parameters to a mathematical equation used to model the object.

As noted previously, in the first preferred embodiment, the print screen remains fixed and the print squeegee moves in a substantially uniform rate across the print screen. In block 524, electronic control unit 400 calculates the incremental squeegee movement based on the complexity of the object to be imprinted and the print resolution required. Typically, this incremental squeegee movement will remain constant during the printing operation for a given object, and thus little or no manipulation will be required to achieve this value. However, in appropriate circumstances, the incremental squeegee movement value could be dynamic during the printing process.

The magnitude of the incremental squeegee movement is largely dependent on the complexity of the object to be imprinted and the required print resolution. If the object to be imprinted is highly complex a larger number of data points may be necessary to model that object, and thus each incremental squeegee movement (representing a single data point) may be relatively small. If the object is simpler, the incremental squeegee movement may be larger, thus resulting in fewer data points. Similarly, for greater resolution, a larger number of data points may be required and for lower resolution a lesser number of data points may be needed, with appropriate adjustments occurring in the incremental squeegee movement. The incremental squeegee movement is represented, for example, by reference numeral 62 shown in FIG. 1(*a*).

Electronic control unit 400 next calculates the object movement vector in block 526. The object movement vector controls the movement of the object to be imprinted along the horizontal and vertical axes and is directly related to the incremental squeegee movement. That is, as seen for example in FIG. 1(*b*), a horizontal object vector component and a vertical object vector component are calculated to result in movement of the object to be imprinted that corresponds to the movement of the squeegee calculated in block 524. Thus, a smaller squeegee incremental movement results in a correspondingly smaller object movement vector. As with the squeegee movement, these values may be determined from a look-up table stored with a memory of electronic control unit 400, or may be mathematically calculated based on parameters detailing the object to be imprinted and the incremental squeegee movement amount. After suitable horizontal and vertical object movement vectors are calculated, a resultant vector, representing the combination of these two vectors is calculated.

Importantly, unlike the incremental squeegee movement, this resultant vector will not remain constant during the printing process. Rather, the resultant vector is determined by electronic control unit 400 so as to ensure that the appropriate portions of the object to be imprinted are located adjacent to the print screen opposite to the squeegee so that the image corresponding to that portion of the print screen is transferred to the object to be imprinted.

Next, in block 528, an object rotation component is calculated in a similar manner. That is, in connection with the incremental squeegee movement and the object movement, object rotation is also required. Therefore, an appropriate object rotation component is determined in a manner similar to that for the resultant object movement vector. In combination with the resultant object movement vector, the rotational component ensures that the proper portion of the object to be imprinted is appropriately positioned adjacent to the print screen. Thus, upon completion of the process in block 528 electronic control unit 400 has determined the three parameters necessary for the following print increment—(1) the incremental squeegee movement; (2) the corresponding resultant object movement vector; and (3) the corresponding object rotation component.

In block 530, electronic control unit 400 then uses these parameters to generate appropriate servo-motor (or other positioning device) control signals, as would be readily apparent to one of skill in the art. Specifically, depending on the particular servo-motors or positioning devices in use, electronic control unit 400 generates appropriate signals instructing the servo-motors to move in accordance with the movement parameters calculated in block 524, 526 and 528. Once these control signals are generated, electronic control unit 400 outputs the signals to the servo-motors in block 532.

The control signals provided to the positioning devices by electronic control unit 400 are such that a smooth transition occurs through each of the above-described movements. That is, the control signals are generated such that the object rotational movement is smoothly completed during the same time period that the object resultant vector movement and the incremental squeegee movement are completed. Therefore, the relative velocity of the movement in each of these respects could vary as necessary to ensure a smooth transition through the desired movement distance.

In block 534, electronic control unit 400 checks to see if additional object data exists, thus indicating that the printing operation is incomplete. If additional data exists, the process returns to block 524 where additional movement vectors are calculated and operated upon. If no additional object data exists, thus indicating that the printing operation is complete, the procedure exits at block 536.

In accordance with the second preferred embodiment of the present invention, the process of block 524 could be replaced with the process of calculating an incremental print screen movement. That is, in the second preferred embodiment, the squeegee remains fixed and the print screen moves (compared to the first preferred embodiment in which the print screen remains fixed and the squeegee moves). Therefore, the process of controlling the printing apparatus in the second preferred embodiment is substantially the same as in the first embodiment except that the process of block 524 calculates an incremental print screen movement rather than an incremental squeegee movement. Thereafter, the remaining procedures are the same, with the print screen movement serving the same purpose as the squeegee movement in the previous example.

Similarly, in the third preferred embodiment (in which the center of object rotation remains fixed), the process of block 524 of determining an incremental squeegee movement can be replaced with the process of calculating an incremental print screen movement and the process of block 526 of determining a horizontal object vector can be replaced with the process of calculating a horizontal squeegee movement. Of course, in the alternative, an incremental squeegee movement could be used with an appropriate print screen movement be calculated based thereon. Again, the remaining portions of the process remain the same as that described above in detail in connection with FIG. 14.

Finally, in the fourth preferred embodiment of the present invention, electronic control unit 400 could generate appropriate control signals for all of the above described parameters using any of them as the incremental reference parameter. That is, an incremental squeegee movement could be determined and a horizontal screen movement and horizontal object movement calculated in combination therefrom. Importantly, in this embodiment, information concerning the performance characteristics of the servo-motors or other positioning devices can be taken into consideration by electronic control unit 400. That is, when calculating the horizontal screen movement and horizontal object movement, electronic control unit 400 could command a greater or lesser movement of one of these components if the position device controlling that component has more or less available power.

Although the invention has been described with reference to specific embodiments, various modifications of the disclosed embodiments as well as other embodiments of the invention will become apparent to persons skilled in the art on reference to the detailed description of the invention contained herein. Accordingly, the claims of the present application should not be limited to the specific embodiments described.

What is claimed is:

1. A printing apparatus for imprinting an object including an irregularly shaped or non-round object comprising:

a print screen;

a squeegee;

an object carriage for holding the object to be imprinted adjacent to said print screen and said squeegee of the printing apparatus;

a plurality of servo-motors for controlling the relative position of the object with respect to said print screen of the printing apparatus and with respect to said squeegee of the printing apparatus, said plurality of servo-motors comprising;

a print screen positioning servo-motor for controlling a horizontal position of said print screen;

a squeegee positioning servo-motor for controlling a horizontal position of said squeegee;

an object rotation servo-motor for controlling a rotational position of the object to be imprinted;

a horizontal object positioning servo-motor for controlling a horizontal position of the object to be imprinted; and a vertical offset servo-motor for controlling a vertical offset between the object to be imprinted and said print screen of said printing apparatus; and an electronic control unit connected with and providing control information to each of said plurality of servo-motors.

2. The printing apparatus of claim 1 wherein said vertical offset servo-motor controls a vertical position of the object to be imprinted.

3. The printing apparatus of claim 1 wherein said vertical offset servo-motor controls a vertical position of the print screen of the printing apparatus and a vertical position of the squeegee of the printing apparatus.

4. The printing apparatus of claim 1 wherein said object carriage is adapted to hold an object which is a bottle.

5. The printing apparatus of claim 1 wherein said electronic control unit is adapted to provide control information regarding an object which has an outer surface parallel to an axis of the object that has at least two different radii of curvature with respect to said axis.

6. The printing apparatus of claim 1 wherein said electronic control unit is adapted to provide control information regarding an object which has an outer surface parallel to an axis of the object that has at least one portion that is flat.

7. The printing apparatus of claim 1 wherein said electronic control unit comprises a central processor, said central processor comprising at least one of a microprocessor, micro-controller, and programmable logic controller.

8. The printing apparatus of claim 7 wherein said electronic control unit further comprises a memory containing data defining an object to be imprinted.

9. The printing apparatus of claim 8 wherein said memory is a non-volatile memory.

10. The printing apparatus of claim 7 wherein said electronic control unit comprises a personal computer having an associated keyboard and video display terminal attached thereto.

11. A printing apparatus for imprinting an object including an irregularly shaped or non-round object comprising:

a print screen;

a squeegee;

object carriage means for holding the object to be imprinted adjacent to said print screen and said squeegee of the printing apparatus;

positioning means for controlling the relative position of the object with respect to said print screen of the printing apparatus and with respect to said squeegee of the printing apparatus, said positioning means comprising;

print screen positioning means for controlling a horizontal position of said print screen;

squeegee positioning means for controlling a horizontal position of said squeegee;

object rotation positioning means for controlling a rotational position of the object to be imprinted;

horizontal object positioning means for controlling a horizontal position of the object to be imprinted; and vertical offset positioning means for controlling a vertical offset between the object to be imprinted and said print screen of said printing apparatus; and control means connected with said positioning means for providing control information to said positioning means.

12. The printing apparatus of claim 11 wherein said positioning means comprises at least one servo-motor.

13. The printing apparatus of claim 11 wherein said positioning means comprises at least one hydraulic actuator.

14. The printing apparatus of claim 11 wherein said positioning means comprises at least one pneumatic actuator.

15. The printing apparatus of claim 11 wherein said control means comprises electronic circuitry.

16. The printing apparatus of claim 15 wherein said control means comprises a microprocessor and associated control software stored in one of a read-only memory or a random access memory.

17. The printing apparatus of claim 16 wherein said control means further comprises a memory containing data defining an object to be imprinted.

18. The printing apparatus of claim 17 wherein said memory is a non-volatile memory.

19. The printing apparatus of claim 16 wherein said control means comprises a personal computer having an associated keyboard and video display terminal attached thereto.

20. A screen printing apparatus for printing on the exterior of an object having a printable surface characterized by a cross-sectional configuration of varying radii of curvature which configuration is uniform along one portion of a rotational axis of the object, comprising a support base, an object carriage for supporting the object for displacement along first and second axes relative to said support base and for rotation about the rotational axis;

a print screen mounted for relative displacement on said support base to allow said print screen to form a movable line of contact with the printable surface of the object as the object is displaced and rotated by the object carriage;

a squeegee mounted for displacement relative to said support base while in contact with said print screen to cause ink to pass through said print screen onto said printable surface at the line of contact;

a plurality of actuators responsive to a plurality of control signals, respectively, including first and second carriage actuators for displacing the object carriage along said first and second axes, respectively, a rotational actuator for rotating the object about the rotational axis, a print screen actuator for displacing said print screen, and a squeegee actuator for displacing said squeegee; and control signal means for providing said control signals to said actuators, respectively, to cause displacement of the object along said pair of axes and rotation of the object about the rotational axis and to cause displacement of said print screen and said squeegee in a manner to minimize acceleration and jerk during screen printing by dynamically varying the velocity of displacement of at least one of the object, said squeegee and said print screen relative to said support base as said line of contact sweeps over portions of the printable surface having different radii of curvature.

21. The screen printing apparatus of claim 20 wherein said control signal means is adapted to provide control information regarding an object which has an outer surface parallel to an axis of the object that has at least two different radii of curvature with respect to said axis.

22. The screen printing apparatus of claim 20 wherein said control signal means is adapted to provide control information regarding an object which has an outer surface parallel to an axis of the object that has at least one portion that is flat.

23. The screen printing apparatus of claim 20 wherein said control signal means comprises a central processor, said central processor comprising at least one of a microprocessor, micro-controller, and programmable logic controller.

24. The screen printing apparatus of claim 23 wherein said control signal means further comprises a memory containing data defining an object to be imprinted.

25. The screen printing apparatus of claim 24 wherein said memory is a non-volatile memory.

26. The screen printing apparatus of claim 20 wherein said control signal means comprises a personal computer having an associated keyboard and video display terminal attached thereto.

* * * * *